US009394728B2

(12) United States Patent
Tomaszewski et al.

(10) Patent No.: US 9,394,728 B2
(45) Date of Patent: Jul. 19, 2016

(54) GLOBAL SIDE DOOR LATCH

(75) Inventors: Kris Tomaszewski, Newmarket (CA); Roman Cetnar, Newmarket (CA)

(73) Assignee: MAGNA CLOSURES INC., Newmarket (CA)

( * ) Notice: Subject to any disclaimer, the term of this patent is extended or adjusted under 35 U.S.C. 154(b) by 339 days.

(21) Appl. No.: 12/891,023

(22) Filed: Sep. 27, 2010

(65) Prior Publication Data

US 2011/0074170 A1 Mar. 31, 2011

Related U.S. Application Data

(63) Continuation of application No. 12/025,266, filed on Feb. 4, 2008, now abandoned.

(51) Int. Cl.

| | |
|---|---|
| ***E05C 3/06*** | (2006.01) |
| ***E05B 77/26*** | (2014.01) |
| ***E05B 81/06*** | (2014.01) |
| ***E05B 81/14*** | (2014.01) |
| ***E05B 85/02*** | (2014.01) |
| ***E05B 77/28*** | (2014.01) |
| ***E05B 79/20*** | (2014.01) |
| ***E05B 81/34*** | (2014.01) |
| *E05B 81/90* | (2014.01) |
| *E05B 77/40* | (2014.01) |

(52) U.S. Cl.

CPC ..... *E05B 77/26* (2013.01); *E05B 77/265* (2013.01); *E05B 77/28* (2013.01); *E05B 79/20* (2013.01); *E05B 81/06* (2013.01); *E05B 81/14* (2013.01); *E05B 81/34* (2013.01); *E05B 85/02* (2013.01); *E05B 77/40* (2013.01); *E05B 81/90* (2013.01); *Y10T 292/1047* (2015.04); *Y10T 292/1052* (2015.04); *Y10T 292/1082* (2015.04)

(58) Field of Classification Search

CPC ..... E05B 81/14; E05B 85/26; E05B 77/06; E05B 77/265; E05B 77/28; E05B 79/20; E05B 81/06; E05B 81/34; E05B 85/02; E05B 77/40; E05B 81/90; Y10T 292/1047; Y10T 292/1052; Y10T 292/1082

USPC ..... 292/216, 201, DIG. 23, 1

See application file for complete search history.

(56) References Cited

U.S. PATENT DOCUMENTS

| | | | | |
|---|---|---|---|---|
| 4,793,640 | A | 12/1988 | Stewart, Sr. | |
| 4,872,366 | A | 10/1989 | Appleby et al. | |
| 4,948,183 | A * | 8/1990 | Yamada | 292/199 |
| 5,000,495 | A * | 3/1991 | Wolfgang et al. | 292/216 |

(Continued)

FOREIGN PATENT DOCUMENTS

WO WO 2006099730 A1 * 9/2006

*Primary Examiner* — Kristina Fulton
*Assistant Examiner* — Nathan Cumar
(74) *Attorney, Agent, or Firm* — Dickinson Wright PLLC

(57) ABSTRACT

The latch includes a ratchet and pawl operable to move between an engaged position to hold a striker and a released position to permit the striker from exiting the latch. In addition, a release lever and a lock lever are pivotally mounted to the opposite surface of the latch housing. A lock link lever connects the release lever to the lock lever, having a first end pivotally mounted to the lock lever and a second end slidably located in a slot on the release lever. Actuating the release lever while the second end of the lock link lever is in its locked position pivots the lock link lever in a first arc and actuating the release lever while the lock link lever is in its unlocked position pivots the lock link lever in a second arc to actuate the pawl into its released position.

15 Claims, 26 Drawing Sheets

(56) References Cited

U.S. PATENT DOCUMENTS

| | | | | | |
|---|---|---|---|---|---|
| 5,020,838 | A | * | 6/1991 | Fukumoto | 292/201 |
| 5,121,952 | A | | 6/1992 | Jason | |
| 5,328,219 | A | | 7/1994 | Konchan | |
| 5,348,357 | A | * | 9/1994 | Konchan et al. | 292/216 |
| 5,503,441 | A | | 4/1996 | Schwaiger | |
| 5,544,925 | A | * | 8/1996 | Ikeda | 292/216 |
| 5,564,761 | A | | 10/1996 | Mizuki et al. | |
| 5,577,583 | A | | 11/1996 | O'Donnell | |
| 5,577,779 | A | | 11/1996 | Dangel | |
| 5,603,537 | A | | 2/1997 | Amano et al. | |
| 5,642,636 | A | * | 7/1997 | Mitsui | 70/237 |
| 5,649,726 | A | | 7/1997 | Rogers, Jr. | |
| 6,305,727 | B1 | | 10/2001 | Bland | |
| 6,328,353 | B1 | | 12/2001 | Barczynski et al. | |
| 6,428,058 | B1 | | 8/2002 | Graute | |
| 6,511,107 | B2 | | 1/2003 | Barczynski et al. | |
| 6,554,328 | B2 | | 4/2003 | Cetnar et al. | |
| 6,575,507 | B2 | | 6/2003 | Reddmann | |
| 6,598,911 | B2 | | 7/2003 | Mejean | |
| 6,601,883 | B1 | | 8/2003 | Kalsi | |
| 6,733,052 | B2 | | 5/2004 | Perkins et al. | |
| 6,749,234 | B2 | * | 6/2004 | Bruce | 292/216 |
| 6,764,113 | B1 | | 7/2004 | Cetnar | |
| 6,880,866 | B2 | | 4/2005 | Tomaszewski et al. | |
| 7,188,872 | B2 | * | 3/2007 | Kalargeros et al. | 292/216 |
| 7,195,292 | B2 | * | 3/2007 | Ketelsen et al. | 292/216 |
| 7,780,205 | B2 | * | 8/2010 | Graute | 292/216 |
| 2002/0167176 | A1 | | 11/2002 | Erices et al. | |
| 2003/0094818 | A1 | | 5/2003 | Tomaszewski et al. | |
| 2005/0087994 | A1 | | 4/2005 | Umino | |
| 2005/0092045 | A1 | | 5/2005 | Dimig et al. | |
| 2005/0099016 | A1 | | 5/2005 | Inoue | |
| 2005/0140148 | A1 | | 6/2005 | Stoof et al. | |
| 2005/0167991 | A1 | | 8/2005 | Yoneyama | |
| 2006/0023390 | A1 | | 2/2006 | Spurr et al. | |
| 2008/0203737 | A1 | * | 8/2008 | Tomaszewski et al. | 292/216 |

* cited by examiner

GLOBAL SIDE DOOR LATCH

CROSS-REFERENCE TO RELATED APPLICATIONS

This application is a continuation of U.S. patent application Ser. No. 12/025,266, filed Feb. 4, 2008.

FIELD OF THE INVENTION

The present invention relates to automotive door latches. More specifically, the present invention relates to door latches used in driver and passenger side door latches.

BACKGROUND OF THE INVENTION

Automotive companies are looking to provide new features for their vehicles, even on traditionally simple components such as latches. Features such as "set and slam latching", double-locking and power-locking are rapidly becoming standard features. For rear doors, child-locks are virtually mandatory. At the same time, automotive manufacturers are looking to standardize parts in order to reduce assembly costs. Therefore, it is desirable to produce a door latch that can accommodate different features within one packaging. For instance, key-only locking (to prevent people from locking their keys in their car) may be desirable for some models or sales regions, but not others. Thus, the latch design must be able to accommodate latches that have and don't have this feature.

Additionally, the latch still needs to be reliable and provide manual fail safes for these new features. For instance, manual locking must be provided in addition to power-locking. Moreover, the manual locking must be able to override the power-locking feature when used.

SUMMARY OF THE INVENTION

It is an object of the invention to provide a novel latch for an automotive door. The latch includes a latch housing having a first and second surface. The first surface on the latch has a channel adapted to receive a striker. A ratchet and pawl are pivotally mounted to the first surface with a portion of the pawl extending through an opening in the housing to the second surface, the ratchet and pawl cooperatively operable to move between an engaged position to hold the striker in the channel, and a released position to permit the striker from exiting the channel, the ratchet and pawl further being biased towards the engaged position. In addition, a release lever is pivotally mounted to the second surface of the latch housing, and movable between a resting and a released position. A lock lever is also pivotally mounted to the second surface, and is movable between a locked and an unlocked position. A lock link lever connects the release lever to the lock lever, having a first end pivotally mounted to the lock lever and a second end slidably located in a slot on the release lever. The second end is movable between a locked and an unlocked position in the slot by pivoting the lock lever between its corresponding locked and unlocked positions. Actuating the release lever while the second end of the lock link lever is in its locked position pivots the lock link lever in a first arc and actuating the release lever while the lock link lever is in its unlocked position pivots the lock link lever in a second arc to actuate the pawl into its released position.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1A:
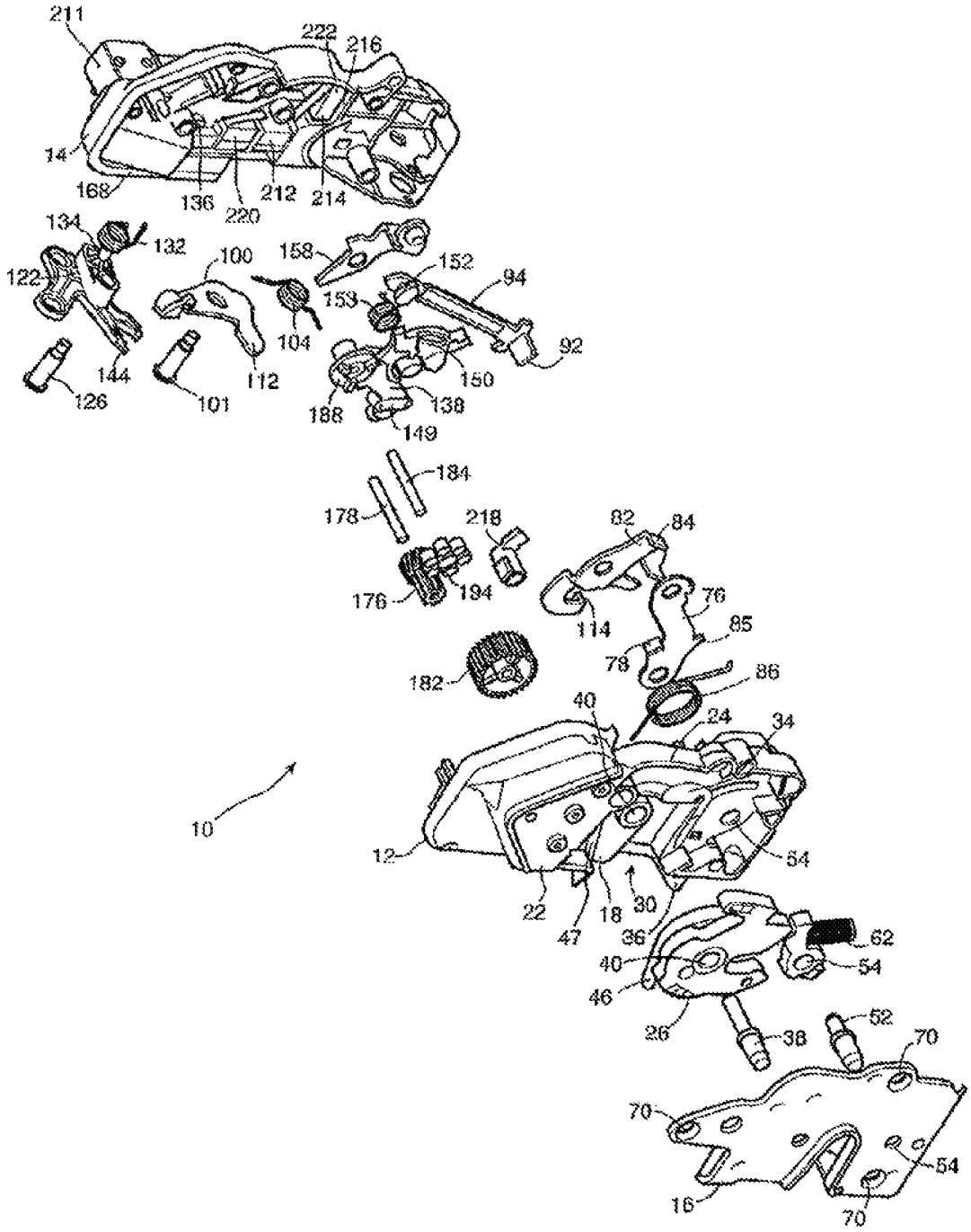
FIGS. 1A and 1B are exploded views of a cable-actuated, front side door latch in accordance with a first embodiment of the invention.
Figure 1B:
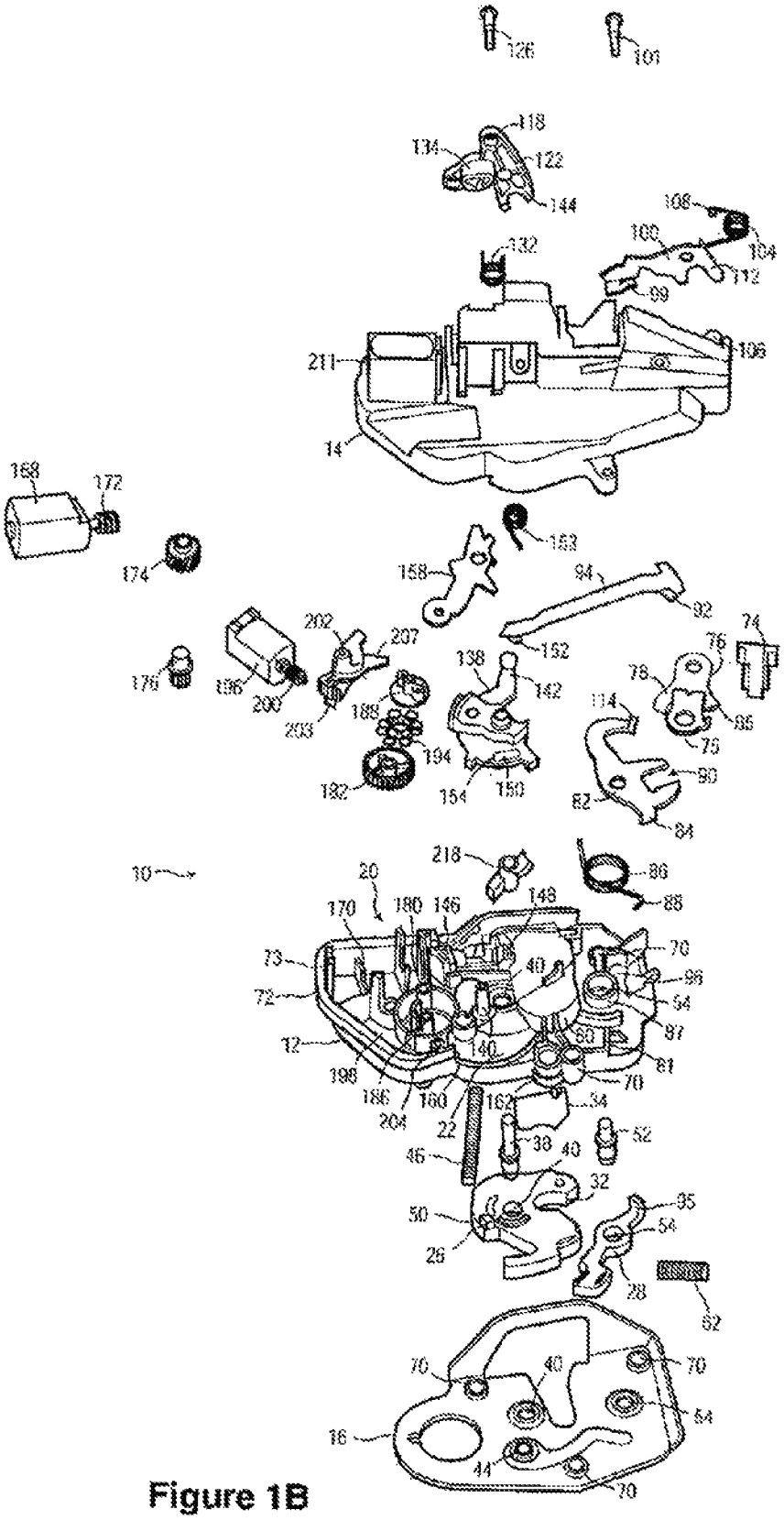

Referring now to FIGS. 1A and 1B, a global latch is shown generally at 10. Latch 10 is adapted to mount to a front side door on a motor vehicle. As is described in greater detail below, latch 10 is rod-actuated via the outside door handle, and cable-actuated via the inside door handle. Latch 10 includes a clam-shell latch housing 12, a complementary latch cover 14, and a frame plate 16. An outer chamber 18 is formed in a recessed area of latch housing 12, and is covered by frame plate 16 (FIG. 1A). An inner chamber 20 is formed between latch housing 12 and latch cover 14 (FIG. 1B). Both latch housing 12 and latch cover 14 are preferably formed from a rigid thermoplastic material.

Housing and Striker Retention

Figure 2:
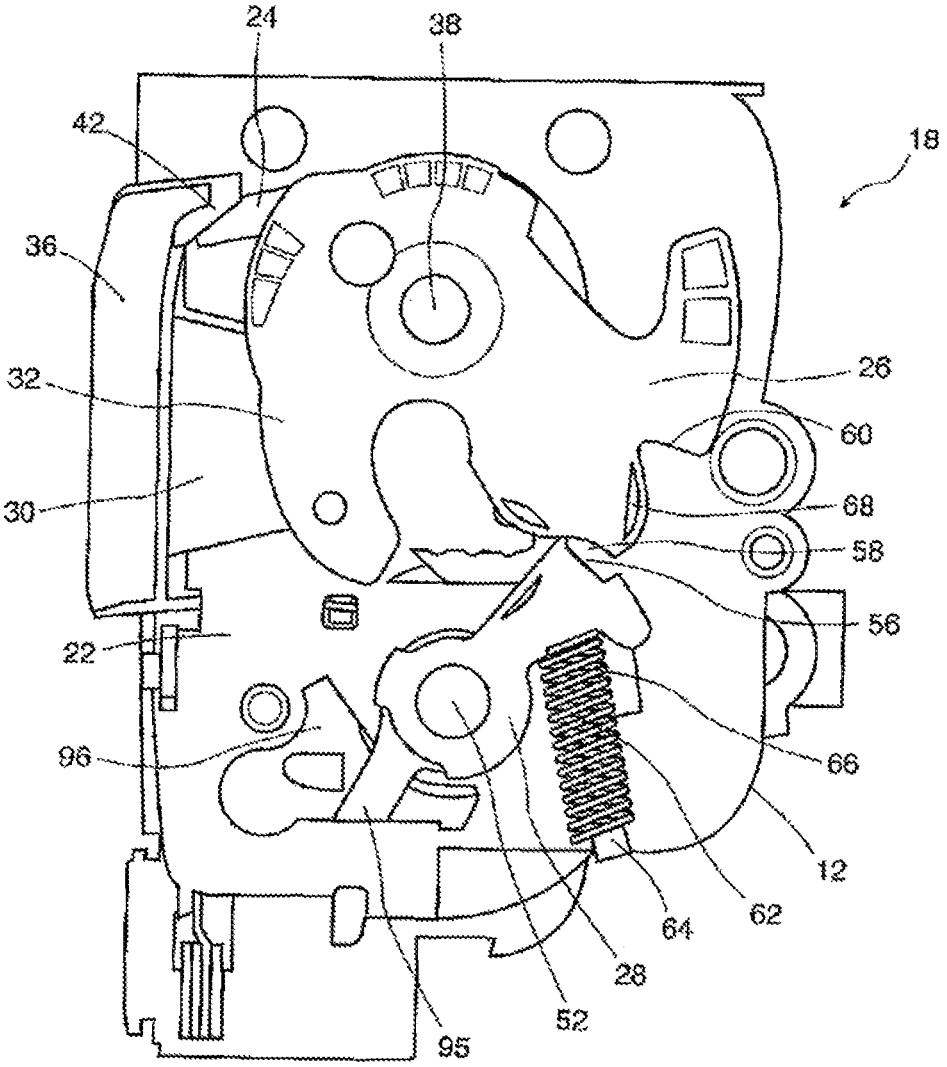
FIG. 2 is a plan view of a latch housing mounted to the latch shown in FIGS. 1A and 1B, with the frame plate removed.

Referring now to FIG. 2, latch housing 12 includes a substrate 22 and peripheral walls 24, which along with frame plate 16 (FIG. 1A) define outer chamber 18. A ratchet 26 and pawl 28 are disposed within outer chamber 18. A frusto-trapezoidal channel, referred to as a "fishmouth" 30 bisects substrate 22. Fishmouth 30 is designed to receive a striker (not shown), which engages a hook arm 32 of ratchet 26, as known to those of skill in the art. Preferably, an elasomeric or rubber overslam bumper 34 is mounted at the apex end of fishmouth 30 (FIG. 1B). Overslam bumper 34 functions to receive and absorb the impact of the striker thus reducing the stresses on the latch and reducing noise. Also preferably, an outer seal 36 is mounted around the orifice of fishmouth to seal the latch opening of the door frame.

Figures 3A, 3B, 3C:
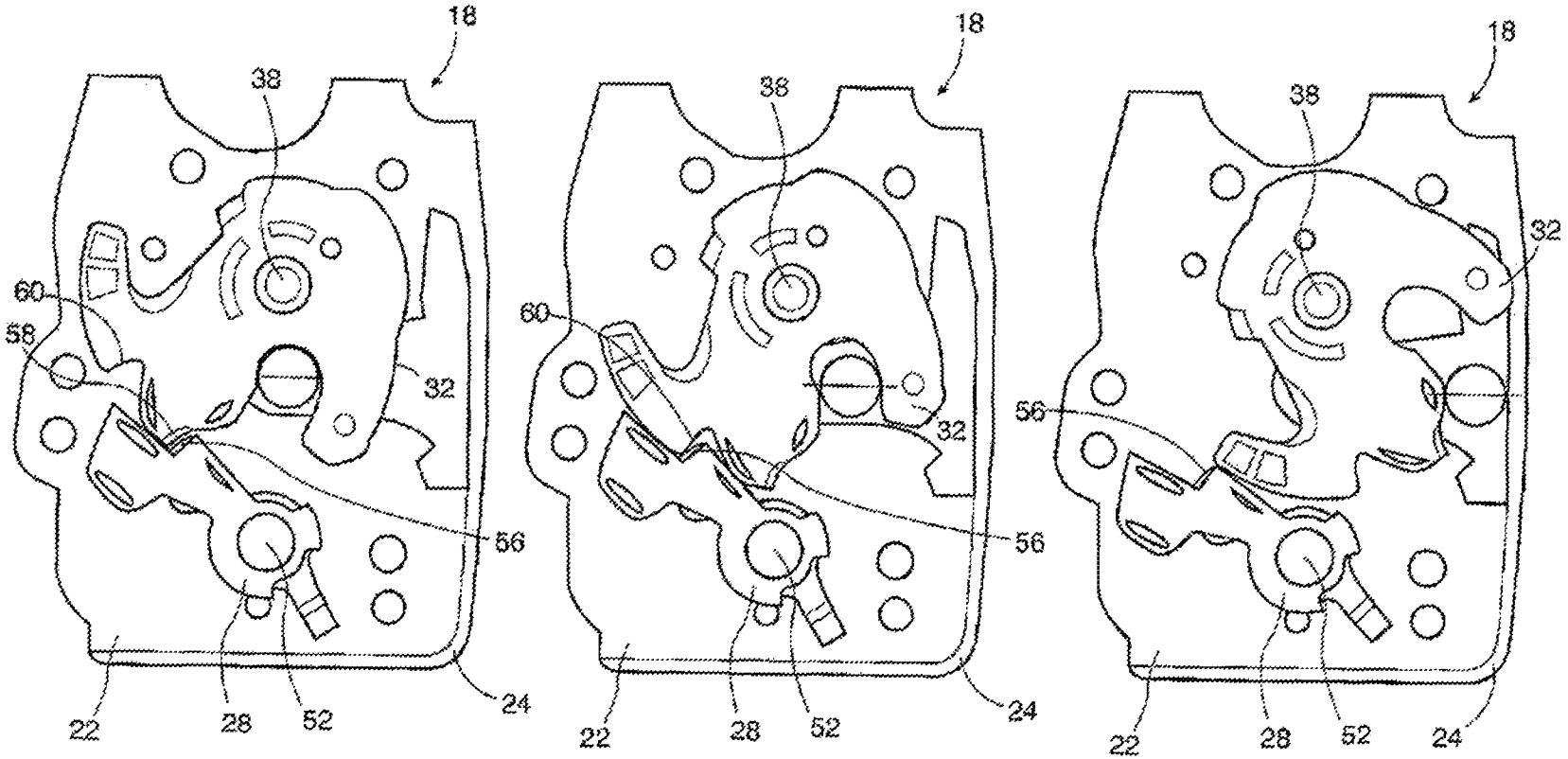
FIGS. 3A, 3B and 3C are partial plan views a ratchet and pawl mounted to the latch housing shown in FIG. 2.

Ratchet 26 is pivotally mounted to substrate 22 via a ratchet rivet 38 inserted into aligned holes 40 provided in substrate 22, ratchet 26 and frame plate 16 (FIG. 1B). As can be seen in FIGS. 3A, 3B and 3C, ratchet 26 is pivotable between a "primary engagement" position (FIG. 3A), a "secondary engagement" position (FIG. 3B), and a "released" position (FIG. 3C). The angular travel of ratchet 26 is delimited by an open position stop bumper 42 (FIG. 2) on outer seal 36 (the released position), and an overslam post 44 depending from frame plate 16 in the overslam position (FIG. 1). When a striker enters fishmouth 30, it rotates ratchet 26 towards the primary engagement position. A ratchet spring 46 (FIG. 1A) urges ratchet 26 towards the released position. Ratchet spring 46 is retained within a spring channel 47 within substrate 22 (FIG. 1A). One end of ratchet spring 46 abuts a sidewall 48 of substrate 22 and the other end abuts a tab 50 (FIG. 1B) depending from ratchet 26 into spring channel 47. Rotating ratchet 26 towards the engagements positions compresses ratchet spring 46.

Pawl 28 is pivotally mounted to substrate 22 via a pawl rivet 52 that is inserted into aligned holes 54 that are provided in substrate 22, ratchet 26 and frame plate 16 (FIG. 1B). Pawl 28 is movable between an "engaged" position where it abuts ratchet 26 or housing 22 and a released position, where it is rotated away from ratchet 26 to permit ratchet 26 to rotate towards the released position. A ratchet shoulder 56 on pawl 28 abuts a primary tooth 58 on ratchet 26 when ratchet 26 is in its primary engagement position, preventing ratchet 26 from rotating towards the released position. Ratchet shoulder 56 abuts a secondary tooth 60 when ratchet 26 is in its secondary position, again preventing ratchet 26 from rotating to the released position. A pawl spring 62 urges pawl 28 towards the engaged position (FIG. 1B). One end of pawl spring 62 abuts a sidewall 64 of substrate 22, and the other end abuts a spring shoulder 66 on pawl 28. Rotating pawl 28 to the released position compresses pawl spring 62.

Ratchet 26 and pawl 28 are preferably constructed out of metal but covered with a plastic material in order to reduce noise during operation. Certain portions subject to wear, such as primary tooth 58 are not covered by plastic. Also preferably, hollow sound dampeners 68 are provided in ratchet 26 and pawl 28 proximate the engaging surfaces. Other forms of sound dampening are within the scope of the invention.

Frame plate 16 is mounted over outer chamber 18 on latch housing 12 (FIG. 1A), and provides a tight seal. Frame plate 16 is secured in place via ratchet and pawl rivets 38 and 52 and screws that pass through aligned fastener holes 70 provided in frame plate 16, latch housing 12 and latch cover 14, and thus hold the structural components of global latch 10 together. Inner chamber 20 (FIG. 1B) is defined by substrate 22 and peripheral sidewalls 72. Latch cover 14 abuts against an inner lip 73 formed by peripheral sidewalls 72. As described above, latch cover 14 is secured against latch housing 12 via screws in fastener holes 70.

Outside Release Assembly

Latch 10 includes an outside release assembly actuated by the outside door handle, and an inside release assembly actuated by the inside door handle. Both the outside and the inside release assemblies act upon pawl 28 to release ratchet 26.

Figure 4:
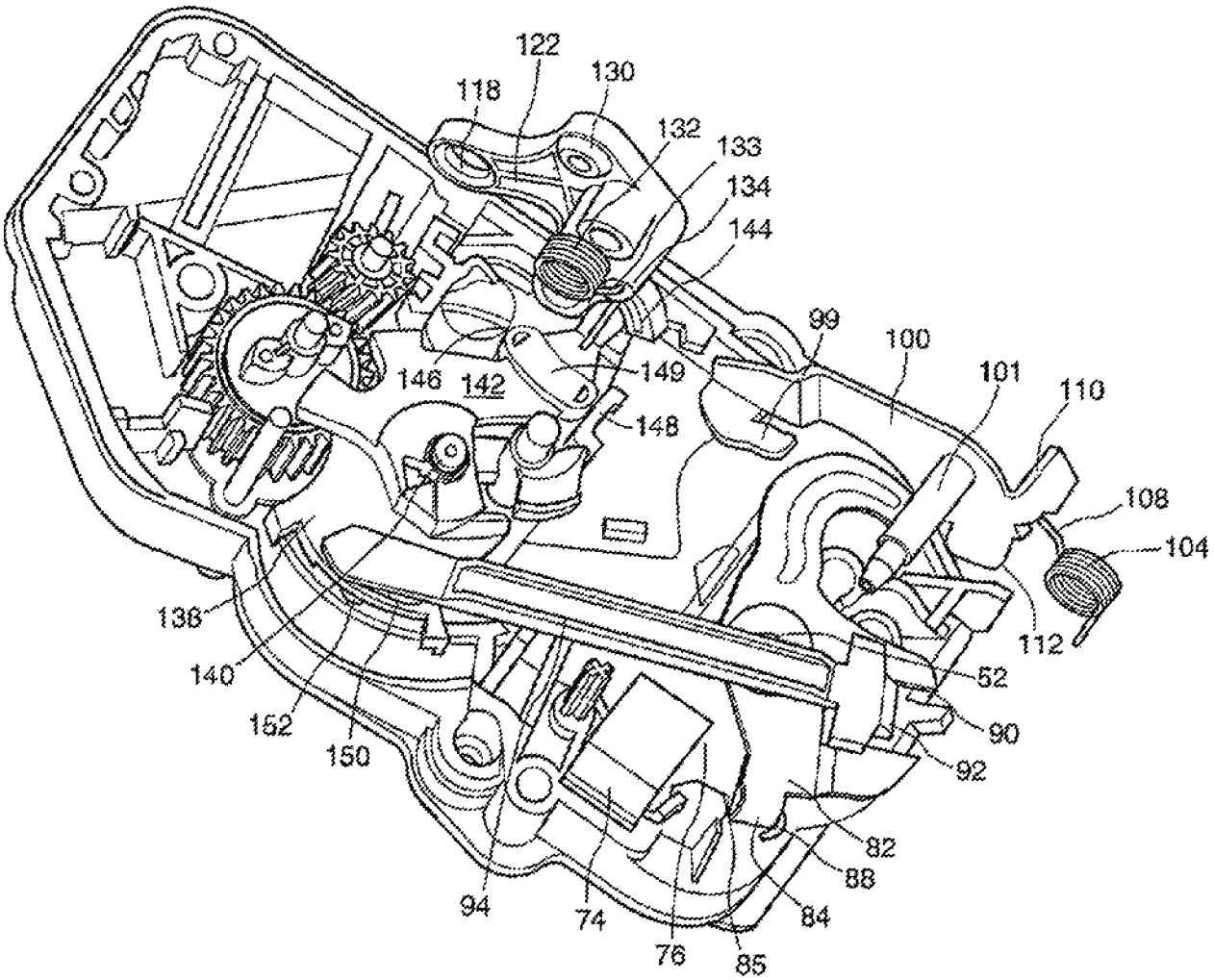
FIG. 4 is an isometric view of the an outside release assembly mounted to the latch shown in FIGS. 1A and 1B.
Figure 5B:
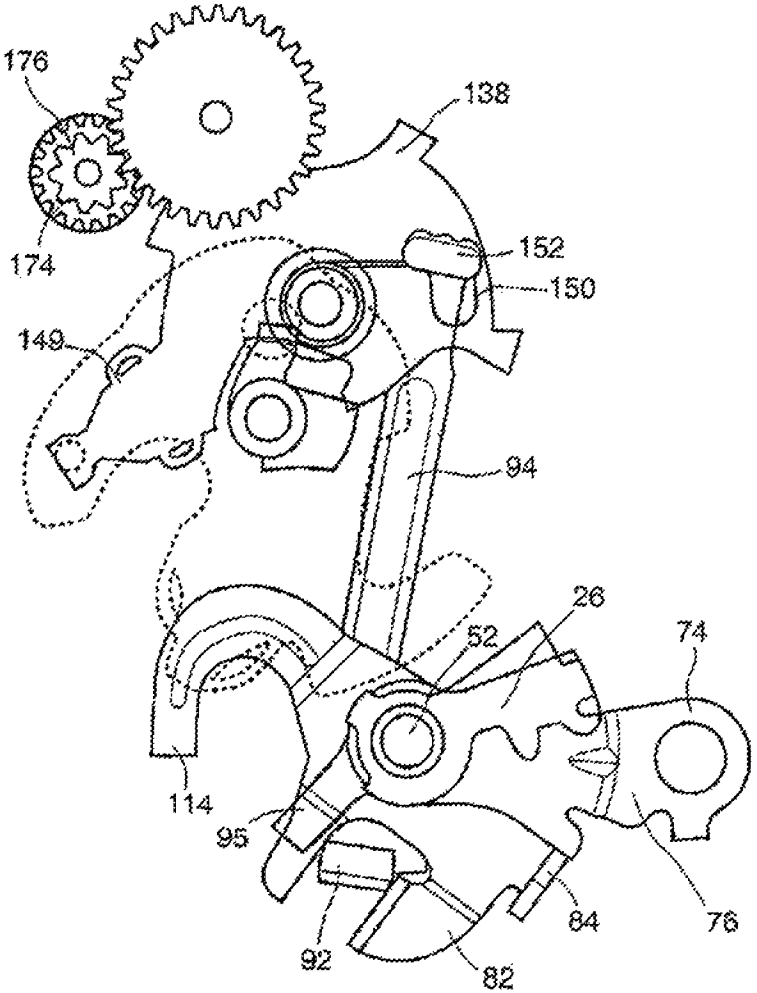
FIGS. 5A and 5B are plan views of the unlocked latch with outside release mechanism mounted to the latch shown in FIG. 4.
Figure 5A:
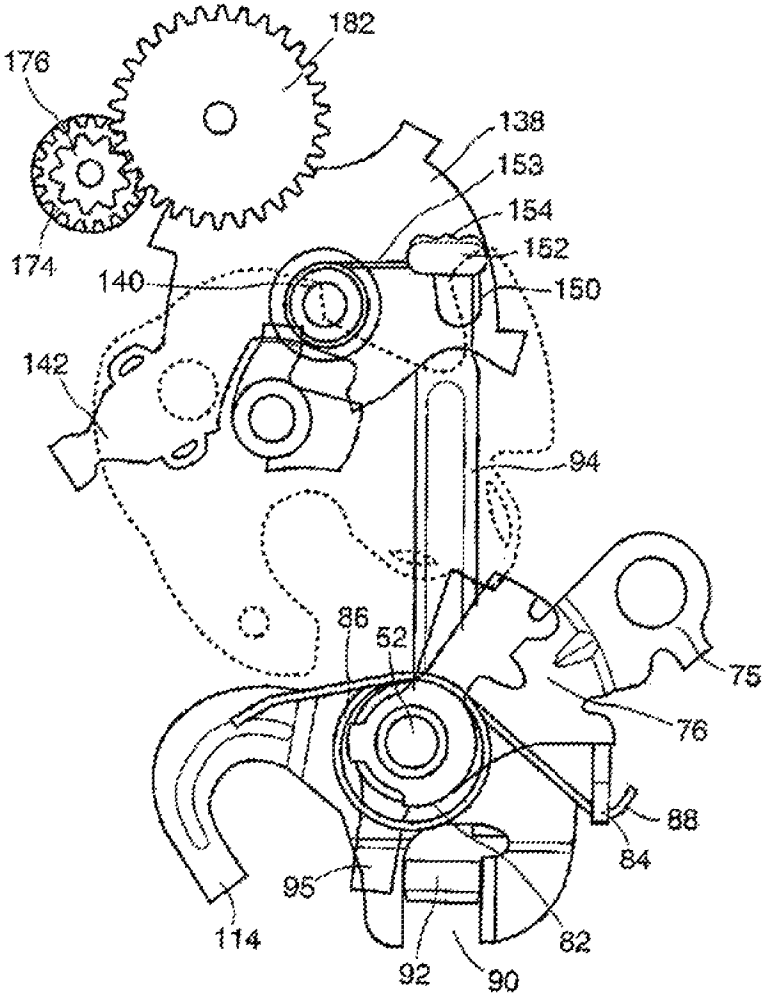

Referring now to FIGS. 4, 5A and 5B the outside release assembly is described in greater detail. Pulling the outside door handle (not shown) actuates a door rod (also not shown). The other end of the door rod terminates in an adjustable rod clip 74, rotatably mounted to a clip arm 75 extending from outside release lever 76. Outside release lever 76 is pivotally mounted around pawl rivet 52. The angular travel of outside release lever 76 is delimited by a depending tab 78 that rotates between sidewalls 80 and 81 formed in substrate 22 (FIG. 1B), and is pivotable between a "resting" position (FIG. 5A), where tab 78 abuts sidewall 80 and an "actuated" position (FIG. 5B) where tab 78 abuts sidewall 81.

A release lever 82 is pivotally mounted around pawl rivet 52, adjacent outside release lever 76. A depending tab 84 on release lever 82 abuts a shoulder 85 on outside release lever 76. A release lever spring 86, pivotally mounted around a hollow post 87 formed in substrate 22 around hole 56 (FIG. 1B), provides a hook 88 wrapped around depending tab 84, thereby coupling release lever 82 with outside release lever 76. As such, actuating outside release lever 76 also actuates release lever 82, and further limits its motion accordingly. In addition, release lever spring 86 biases both outside release lever 76 and release lever 82 towards their resting positions.

Figure 8B:
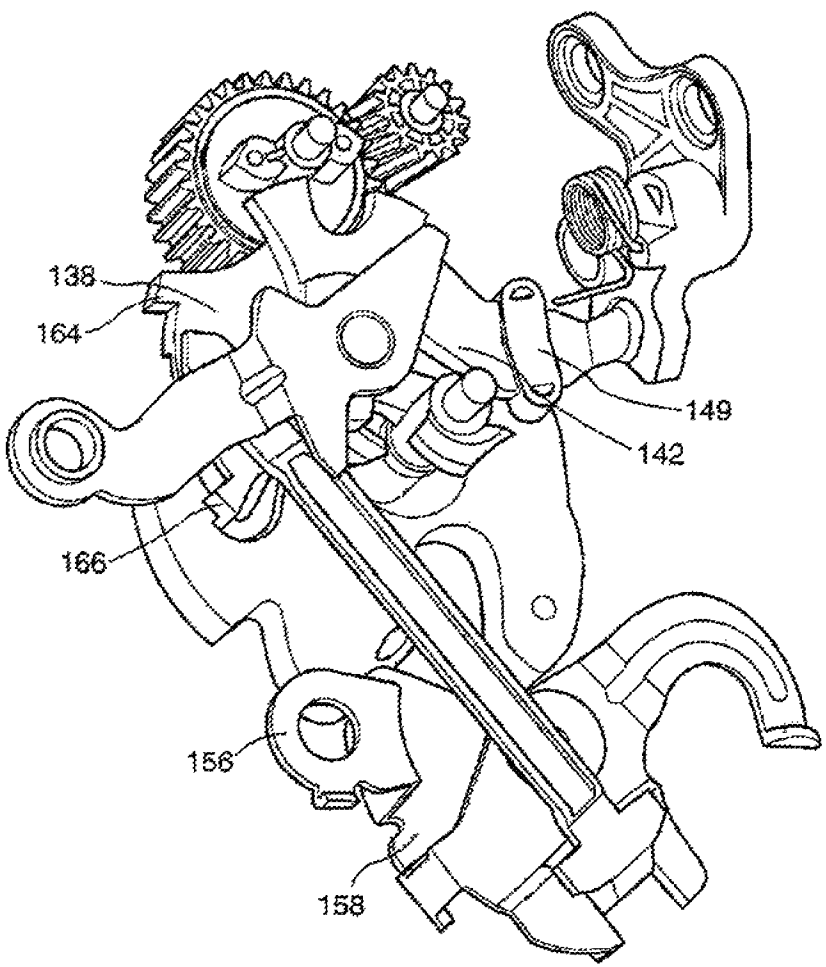
FIGS. 8A and 8B are isometric views of the manual inside and outside lock assemblies mounted to the latch shown in FIGS. 1A and 1B.

A lock link slot 90 is provided in release lever 82, and a lock link tab 92 depending from a lock link lever 94 is situated therein. Lock link lever 94 is slidable between an "unlocked" position where it is maximally retracted into lock link slot 90, and "locked" position where it extends out to near the mouth of lock link slot 90. FIG. 5A shows lock link lever in the unlocked position. (FIG. 8B shows lock link lever 94 in the locked position.) When located in the unlocked position, lock link tab 92 abuts a pawl insert 95 that depends from pawl 28 through a slot 96 in substrate 22 (FIG. 1B). Actuating release lever 82 when lock link tab 92 is in the unlocked position actuates pawl insert 95, thus releasing ratchet 26 to its released position. When located in the locked position, lock link tab 92 is displaced away from pawl insert 95. Thus, actuating release lever 82 when lock link tab 92 is in the locked position does not actuate pawl insert 95 to release ratchet 26. As is described in greater detail below with reference to the outside lock, actuating release lever 82 does not inhibit the outside handle locking/unlocking function.

Inside Release Assembly

Figure 6B:
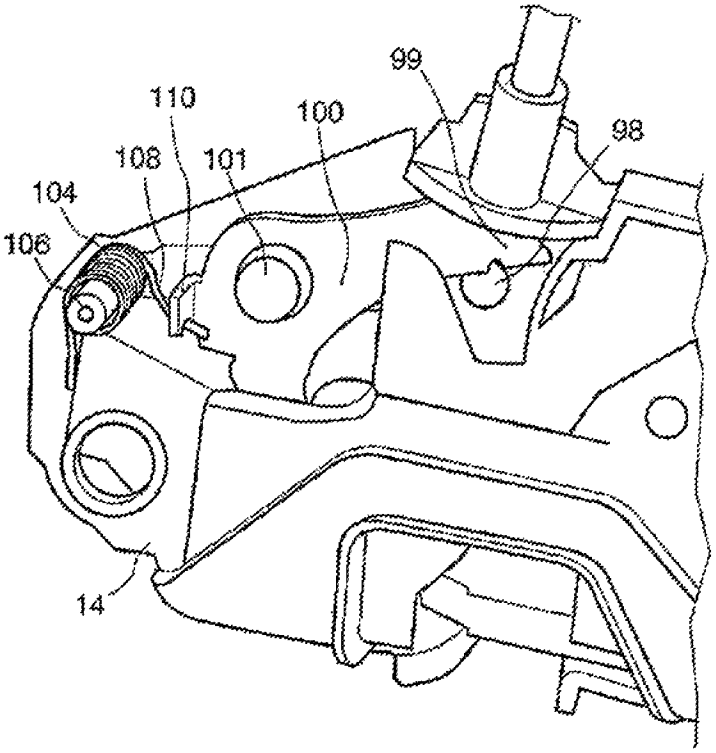
FIGS. 6A and 6B are isometric views of the inside release lever.
Figure 6A:
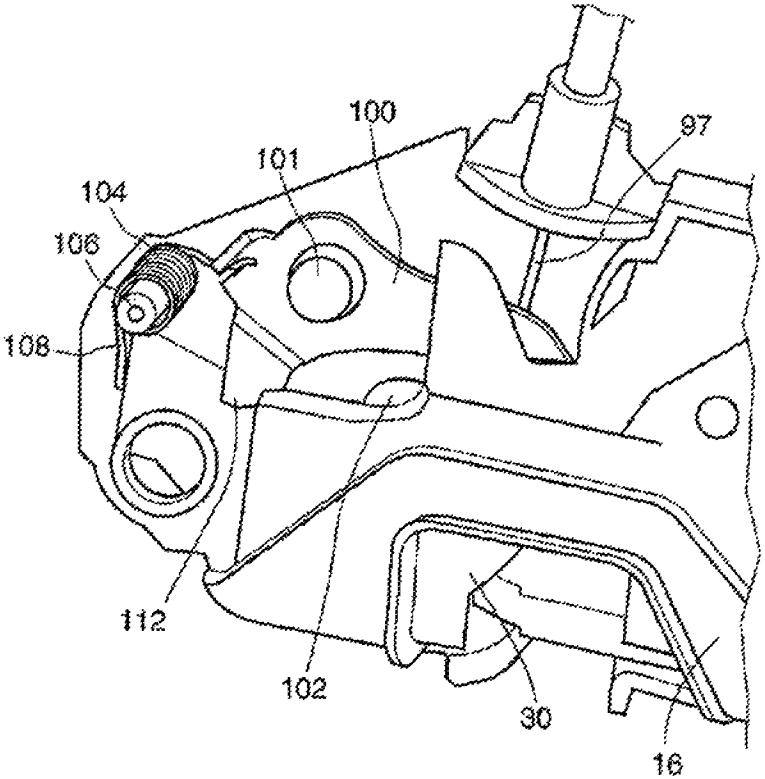
Figure 7B:
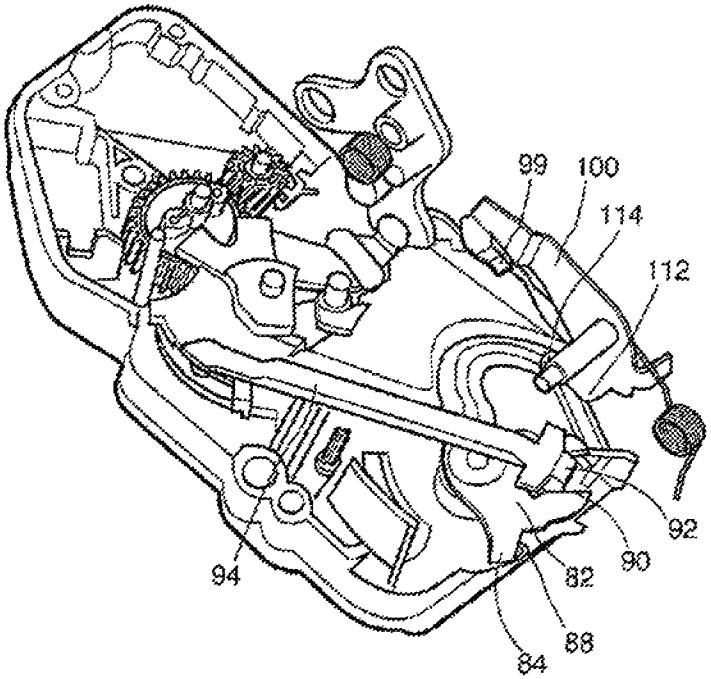
FIGS. 7A and 7B are isometric views of the inside release assembly mounted to the latch shown in FIGS. 5A and 5B including the latch housing.
Figure 7A:
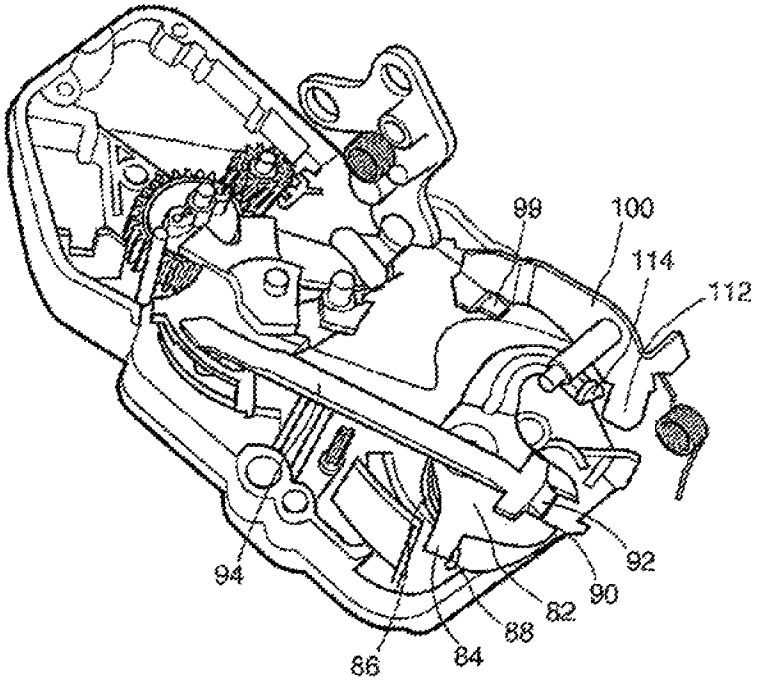

Referring now to FIGS. 5A, 5B, 6A, 6B, FIGS. 7A and 7B, the inside release assembly will now be described in greater detail. Pulling the inside door handle (not shown) actuates an inside door cable 97. A ball end 98 of the inside door cable 97 is attached to a hook arm 99 on inside release lever 100. Inside release ever 100 is pivotally mounted around a lever rivet 101 that is mounted in a hole provided in the surface of latch cover 14 (FIG. 1B), and is movable between a resting position (shown in FIGS. 5A, 6A and 7A) and an actuated position (FIGS. 5B, 6B and 7B). The angular travel of inside release lever 100 is delimited by a tab 102 on latch cover 14 and ball end 98. An inside release lever spring 104, pivotally mounted around a post 106 formed in the substrate of latch cover 14, provides arms 108 that abut a sidewall portion 109 on latch cover 14 and a tab 110 on inside release lever 100, thereby biasing inside release lever 100 towards the resting position. A depending tab 112 on inside release lever 100 abuts an inside release arm 114 on release lever 82 (FIG. 5A). Thus, actuating inside release lever 100 also actuates release lever 82 (FIG. 5B). As described above, actuating release lever 82 when link lock tab 92 is in the unlocked position actuates pawl insert 95 to release the latch.

Inside Lock/Unlock Assembly

Figure 8A:
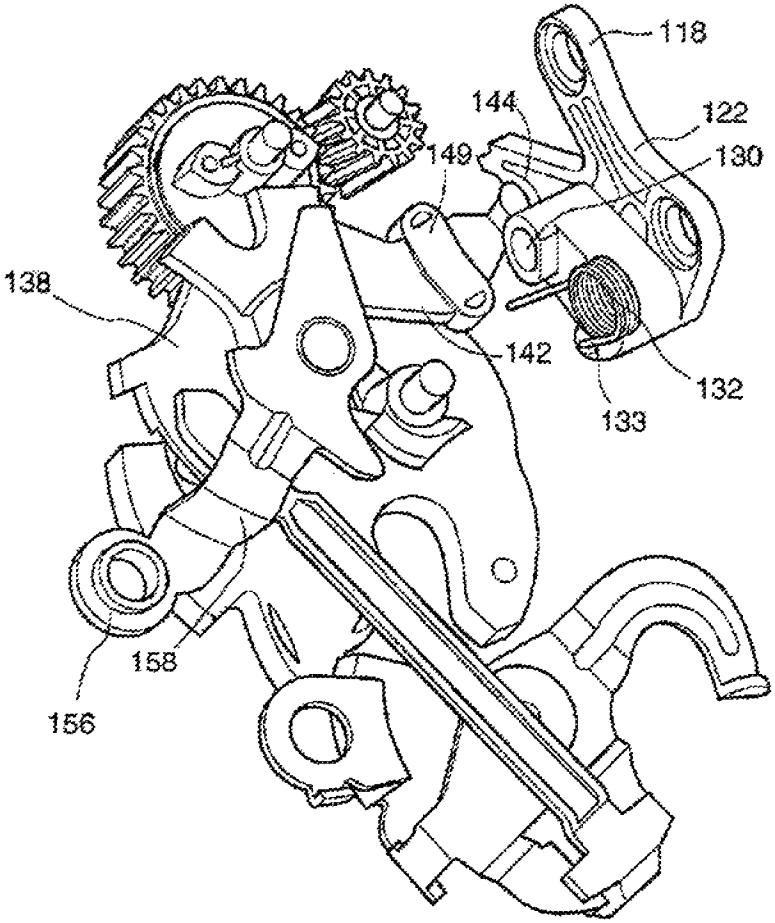

Referring now to FIGS. 4, 8A and 8B, the inside lock/unlock assembly will now be described in greater detail. Manually releasing the inside lock switch (not shown) actuates a lock rod (also not shown). The other end of the lock rod is attached to a loop 118 on inside lock lever 122. Inside lock lever 122 is pivotally mounted around a lever rivet 126 (FIG. 1B) that is mounted in aligned rivet holes 130 provided in inside lock lever 122, and the surface of latch cover 14. Inside lock lever pivots between a "locked" position (FIG. 8A) and an "unlocked" position (FIG. 8B). A lock toggle spring 132 having a first spring arm 133 mounted within a lever post hole 134 depending from inside lock lever 122, and a second spring arm 133 mounted within a cover post hole 136 depending from latch cover 14 (FIG. 1A) biases inside lock lever 122 to either the locked or the unlocked positions.

A lock lever 138 is pivotally mounted to a post 140 extending from substrate 22 within inner chamber 20. An arm 142 extends from lock lever 138 and is actuated by a claw 144 provided at the end of inside lock lever 122. The angular travel of lock lever 138 is delimited by a shoulder 146 and 148 formed from substrate 22. Lock lever 138 is movable between a locked position, where arm 142 abuts shoulder 146 (FIG. 8A), and an unlocked position where arm 142 abuts shoulder 148 (FIG. 8B). To reduce noise and wear, a lock lever bumper 149 is preferably mounted around arm 142. When lock lever 138 moves into either the locked or the unlocked position, bumper 149 abuts one of shoulder 146 and 148.

A slot 150 is provided in lock lever 138. A link lock tab 152 formed from the end of lock link lever 94 opposite lock link tab 92 is retained within slot 150. As can be more clearly seen in FIGS. 5A and 5B a lock link spring 153 is pivotally mounted around post 140 and urges link lock tab 152 against sidewall 154 of slot 150. This arrangement translates the rotational movement of lock lever 138 into linear motion of lock link lever 94, so that lock link lever 94 is in the unlocked position when lock lever 138 is in the unlocked position, and lock link lever 94 is in the locked position when lock lever 138 in the locked position.

Should release lever 82 be actuated (i.e., someone is pulling on the inside or outside door handles) when lock lever 138 is moved from the locked to the unlocked position, ratchet 26 does not release. However, once release lever 82 is released (i.e., the inside or outside door handle is released), lock link spring 153 moves lock link lever 94 to the unlocked position, so that re-actuating release lever 82 by pulling on the inside or outside door handle will now release ratchet 26.

Outside Lock/Unlock Assembly

Still referring to FIGS. 8A and 8B, the outside lock/unlock assembly will now be described. Turning the outside lock key cylinder (not shown) actuates an outside lock rod (also not shown). The other end of the outside lock rod is attached to a loop 156 on an outside lock lever 158. Outside lock lever 158 is pivotally mounted to post 140 over lock lever 138. The angular motion of outside lock lever 158 is delimited by shoulder stops 160 and 162 formed from substrate 22 (FIG. 1B). As outside lock lever 158 pivots between these two shoulders, it engages one of outside shoulders 164 and 166 formed on lock lever 138, pivoting lock lever 138 as well. Thus, by pivoting outside lock lever 158, lock lever 138 is moved between the locked and unlocked positions.

Power Lock/Unlock Assembly

Figure 9:
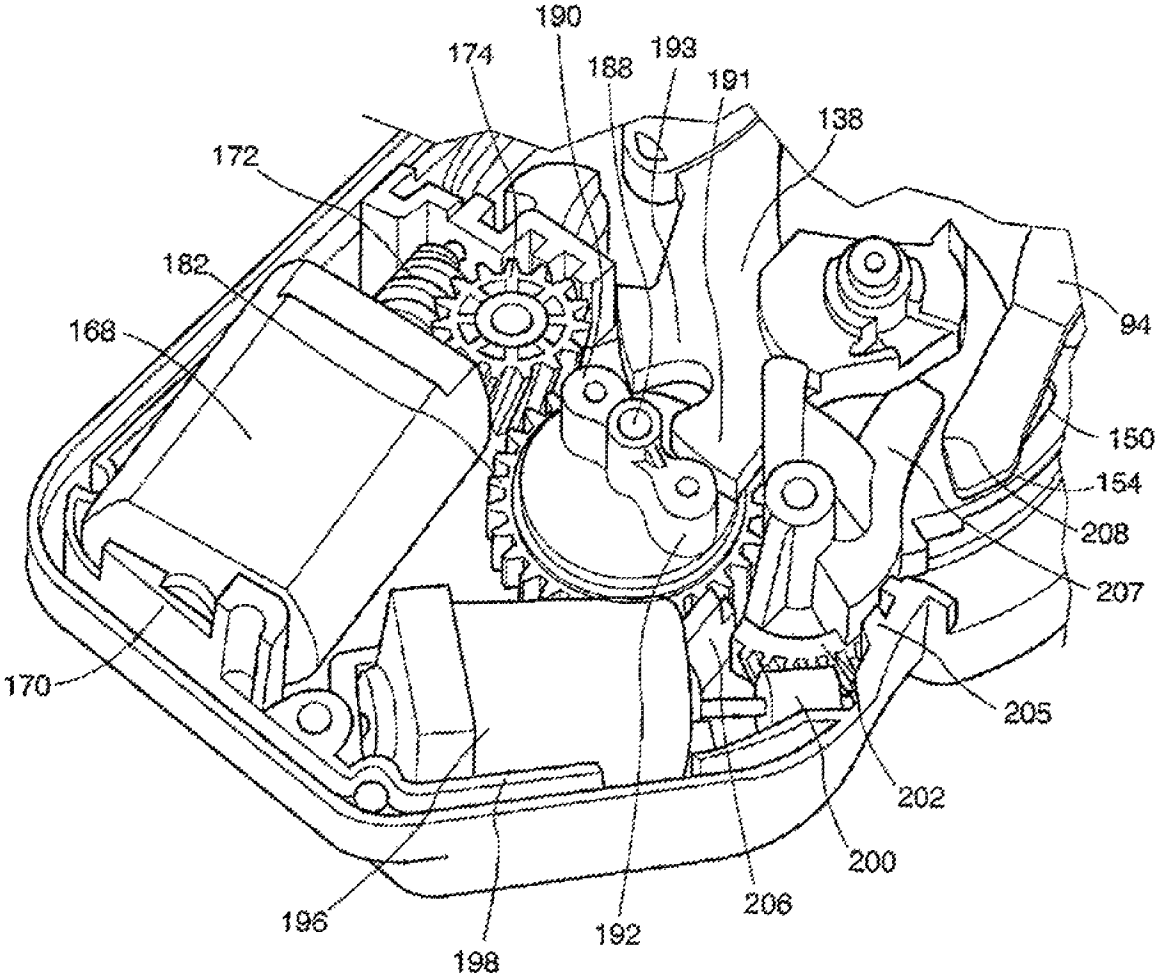
FIG. 9 is an isometric view of a power lock assembly mounted to the latch shown in FIGS. 8A and 8B.

In addition to manually locking and unlocking latch 10 via the inside or outside lock levers, a user can electrically lock and unlock the latch. Referring now to FIG. 9, the power lock/unlock assembly will now be described. Activating a power lock/unlock switch inside the passenger cabin or on a remote key fob (not shown) engages a lock motor 168, housed in a lock chamber 170, integrally formed from substrate 22. Lock motor 168 is a DC motor, and reversibly drives a worm 172. Worm 172, in turn meshes with a worm gear 174, connected to a pinion 176 (FIGS. 5A and 5B) which in turn, is rotatably mounted to a pin 178 located in a hole 180 in substrate 22 (FIG. 1B). Pinion 176 meshes with a gear spur 182. Gear spur 182 is rotatably mounted to a pin 184, located in a hole 186 in substrate 22 (FIG. 1B).

A cam 188 is mounted to gear spur 182. Engaging lock motor 168 drives worm 172, which in turn drives worm gear 174. Worm gear 174 drives gear spur 182, rotating cam 188 rotates as well. When cam 188 is rotated in a first direction (clockwise), a cam arm 190 on cam 188 engages a side surface of cam shoulder 191 on lock lever 138, pivoting lock lever 138 to the locked position. When lock lever 138 moves into the locked position, a cam arm 192 abuts against cam shoulder 193, preventing further rotation clockwise. Engaging lock motor 168 in reverse causes cam 188 to rotate in the other direction (counterclockwise). Cam arm 190 engages a side surface of cam shoulder 193, pivoting lock lever 138 into the unlocked position. When lock lever 138 moves into the unlocked position, cam arm 192 abuts against cam shoulder 191, preventing further rotation counterclockwise. A radial bumper 194 mounted between cam 188 and gear spur 182 (FIG. 1B) provides a dampening effect. If desired, a frictional spring 195 (FIG. 9B), located around a post 197 can be wrapped around cam 188 to further reduce bounce-back of the cam arms at the end of travel.

Double Lock Assembly and Deadbolt Override Assemblies

Still referring to FIG. 9, the double locking assembly will now be described. The double lock assembly disables the inside and outside release assemblies. The double lock assembly can be engaged only electrically and only when the latch is already in locked position. It can be disengaged electrically or by operating outside key cylinder as described below. The double lock assembly includes a double lock motor 196, housed in a double lock chamber 198, integrally formed from substrate 22. Double lock motor 196 is a DC motor, and reversibly drives a worm 200. Worm 200, in turn meshes with a deadbolt sector gear 202, rotatably mounted around a post 203 located in a hole 204 in substrate 22 (FIG. 1B). The angular motion of deadbolt sector gear 202 is limited by deadbolt sidewalls 205 and 206, formed from substrate 22, so that deadbolt sector gear 202 is movable between an unlocked position when it abuts deadbolt sidewall 205, and a locked position when it abuts deadbolt sidewall 206.

A deadbolt arm 207 extending from deadbolt sector gear 202 is adjacent lock link lever 94. When deadbolt sector gear 202 is in the unlocked position, lock link lever 94 operates normally. When the lock lever 138 is in locked position and deadbolt sector 202 is moved to its locked position the tip of deadbolt arm 207 engages a side face 208 on lock link lever 94, thereby blocking lock link lever 94 in its position. Thus, lock link lever 94 remains in its locked position even when lock lever 138 is pivoted to its unlocked position. When deadbolt sector gear 202 returns to the unlocked position, link lock spring 153 returns link lock lever 94 to its starting position adjacent sidewall 154, so that lock link lever 138 actuates link lock lever 94 normally.

Figure 10B:
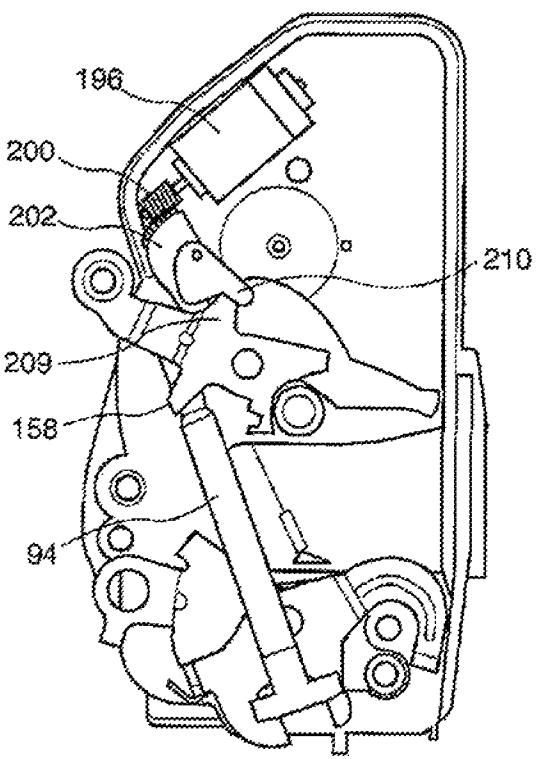
FIGS. 10A and 10B are plan views of a double lock assembly and manual double lock override mounted to the latch shown in FIG. 9.
Figure 10A:
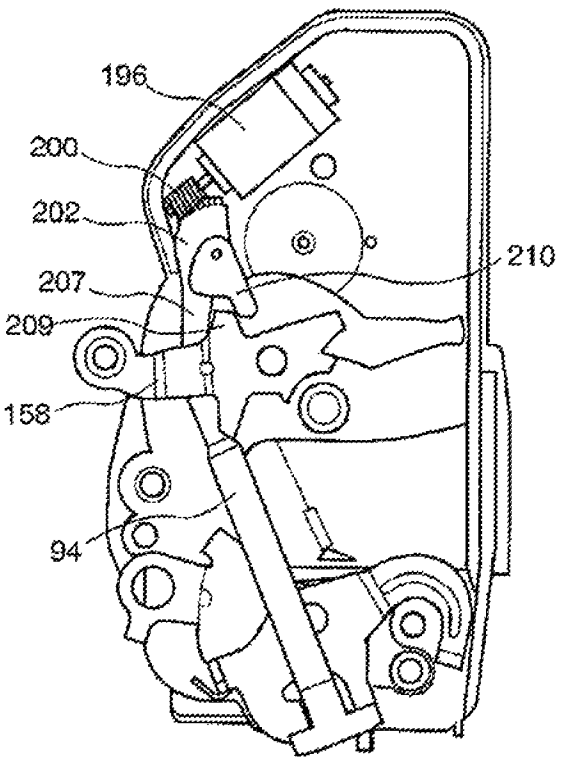

Referring now to FIGS. 10A and 10B, a manual override for the double lock is provided, should power or double lock motor 196 fail. If outside lock lever 158 is actuated to the unlocked position while deadbolt sector gear 202 is in the locked position (i.e., by turning the key cylinder), a shoulder 209 on outside lock lever 158 actuates a release arm 210 on deadbolt sector gear 202, pivoting it back to the unlocked position (FIG. 10B), and allowing lock lever 138 and link lock lever 94 to operate normally.

Electrical Assemblies

Power and control for the electrical systems of latch 10 are provided via a wiring harness (not shown) that communicates with the interior of latch 10 via connector passage 211 in latch cover 14 (FIG. 1B). The wiring harness connects to lock motor 168 and dead bolt motor 196. Referring now to FIGS. 11, 12A, 12B and 12C, a number of sensor switches are also provided, mounted to latch housing 12. These include door ajar switch 212 (having a closed and an ajar state), door open switch 214 (having a closed and an open state). Door ajar switch 212 and door open switch 214 are mounted within switch niches 216 that are integrally formed from the inner surface of latch cover 14, adjacent to a switch cam 218 that extends outwards from latch housing 12. Switch cam 218 is mounted to ratchet rivet 38, so that switch cam 218 rotates in tandem with ratchet 26. When ratchet 26 is pivoted into the primary engagement position (FIG. 12A), switch cam 218 does not contact either switch, so both door ajar switch 212 and door open switch 214 are in the closed state. When ratchet 26 is pivoted into the secondary engagement position (FIG. 12B), indicating that the door is only partially closed, switch cam 218 engages door ajar switch 212, placing it in the ajar state. When ratchet 26 is pivoted into the released position (FIG. 12C), switch cam engages both switches, so door ajar switch 212 is in the ajar state, and door open switch 214 is in the open state. Other arrangements of switches in relation to switch cam 218 will occur to those of skill in the art.

Figure 13B:
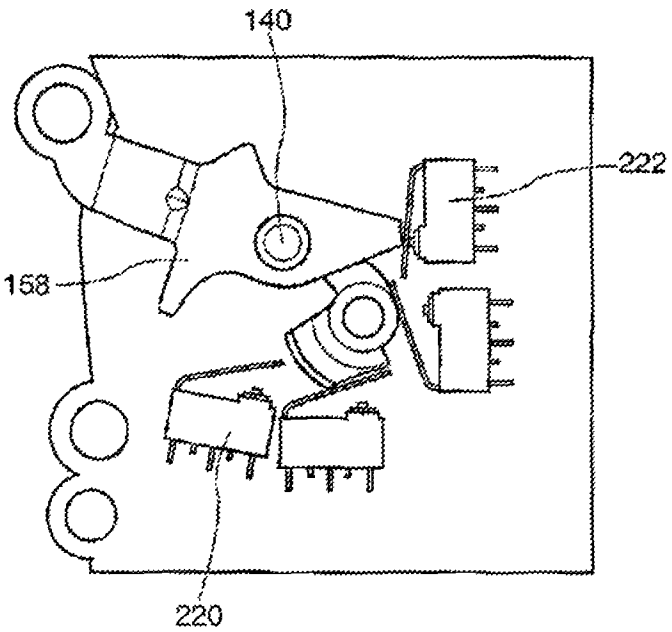
FIGS. 13A and 13B are plan views showing a door lock and a door unlock switch in relation to outside lock lever mounted to the latch shown in FIGS. 12A, 12B and 12C with the latch cover removed.
Figure 13A:
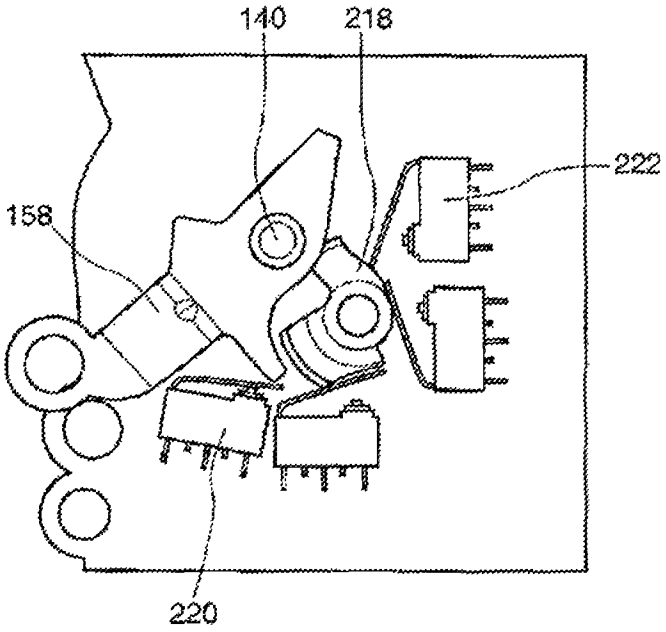

Referring now to FIGS. 13A and 13B, an outside lock switch 220 and an outside unlock switch 222 are mounted within switch niches 216, in addition to door ajar switch 212 and door open switch 214. Both switches have an engaged and disengaged state. Outside lock switch 220 and outside unlock switch 222 are not actuated by switch cam 218, but rather by outside lock lever 158. When outside lock lever 158 is in the locked position (FIG. 13A), outside lock switch 220 is in the engaged state and outside unlock switch 222 is in the disengaged state. When outside lock lever 158 is in the unlocked position (FIG. 13B), outside unlock switch 222 is in the engaged state and outside lock switch 220 is in the disengaged state. When outside lock lever 158 is between the locked and unlocked positions, both outside lock switch 220 and outside unlock switch 222 are in the disengaged state. Moving outside lock switch 220 to the engaged state engages door lock motor 168 and double lock motor 196 to lock all the other latches 10 in the vehicle. Moving outside lock switch 220 to the disengaged state engages lock motor 168 and double lock motor 196 to unlock all the other latches 10 in the vehicle.

It is possible to provide outside lock switch 220 and outside unlock switch 222 in some latches 10 on the vehicle, but omit them in other latches 10. For example, the latch 10 on the driver side may be equipped with outside lock switch 220 and outside unlock switch 222, but the latch 10 on the passenger side is not. Other arrangements of switches in relation to outside lock lever 158 will occur to those of skill in the art.

Key Only Locking and Set and Slam Locking

Figure 14B:
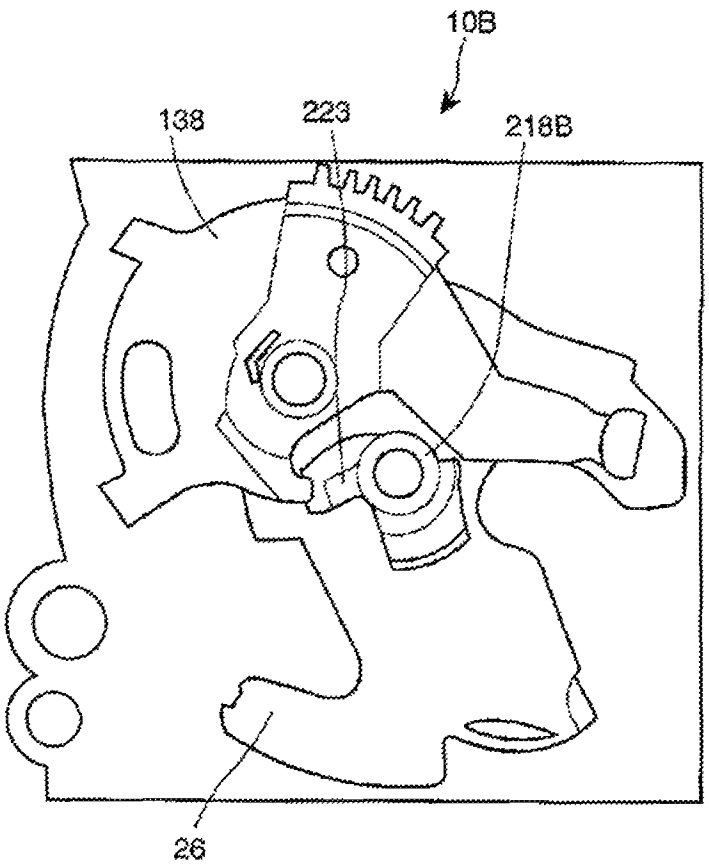
FIGS. 14A and 14B are plan views showing a key-only lock assembly mounted to a side door latch in accordance with another embodiment of the invention.
Figure 14A:
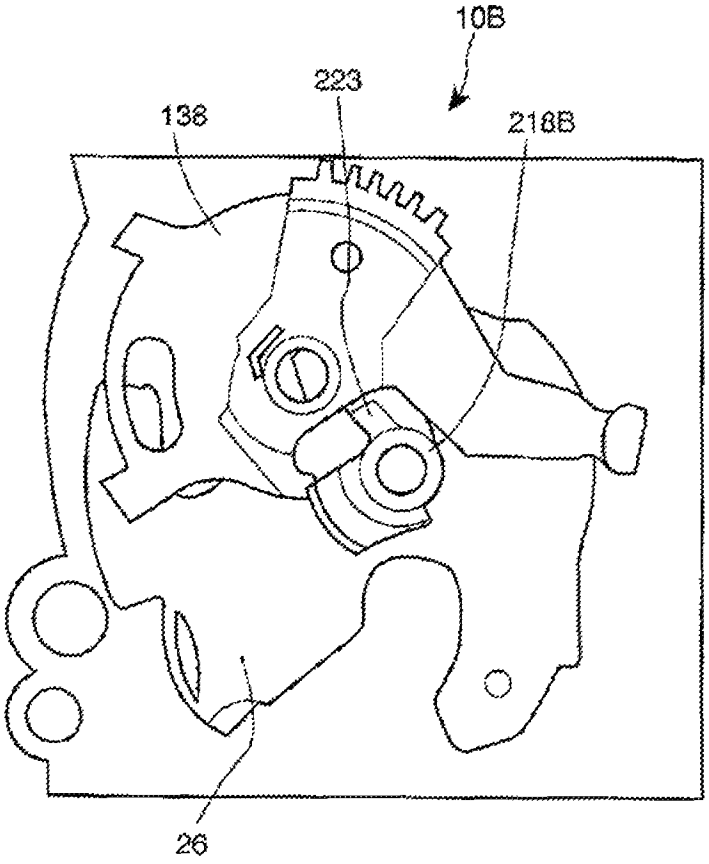

The above description of latch 10 describes one embodiment of the invention, specifically a front side door latch. Other embodiments of latch 10 are within the scope of the invention. For example, latch 10 can be locked both when the door is closed (i.e., ratchet 26 is in the primary or secondary engagement position), or when the door is open (i.e., ratchet 26 is in the released position). This latter method of locking is referred to as "set and slam locking. However, an optional key-only locking system can be provided to help prevent occupants from locking themselves out of the vehicle. Latch 10B provides a key-only locking system. Referring now to FIGS. 14A and 14B, switch cam 218B (which replaces switch cam 218) includes a lockout tab 222 that extends outwards radially from ratchet rivet 38. As can be seen in FIG. 14A, when ratchet 26 is in either of the primary or secondary engagement positions, lock lever 138 operates normally, and can move between the locked and unlocked positions. (Specifically, FIG. 14A shows ratchet 26 in the primary engagement position). As can be seen in FIG. 14B, when ratchet 26 rotates to the released position, switch cam 218B also rotates so that lockout tab 222 abuts a lockout shoulder 223 on lock lever 138, thereby preventing lock lever 122 from moving to the locked position. (Lock lever 138 must be in the unlocked position to release latch 10B.) Thus, it is impossible to lock latch 10B when ratchet 26 is in the released position. When ratchet 26 is in either of the primary or secondary engagement positions, then normal movement of lock lever 122 between the locked and unlocked positions is possible.

Rear Door Latch with Child Lock

Figure 15:
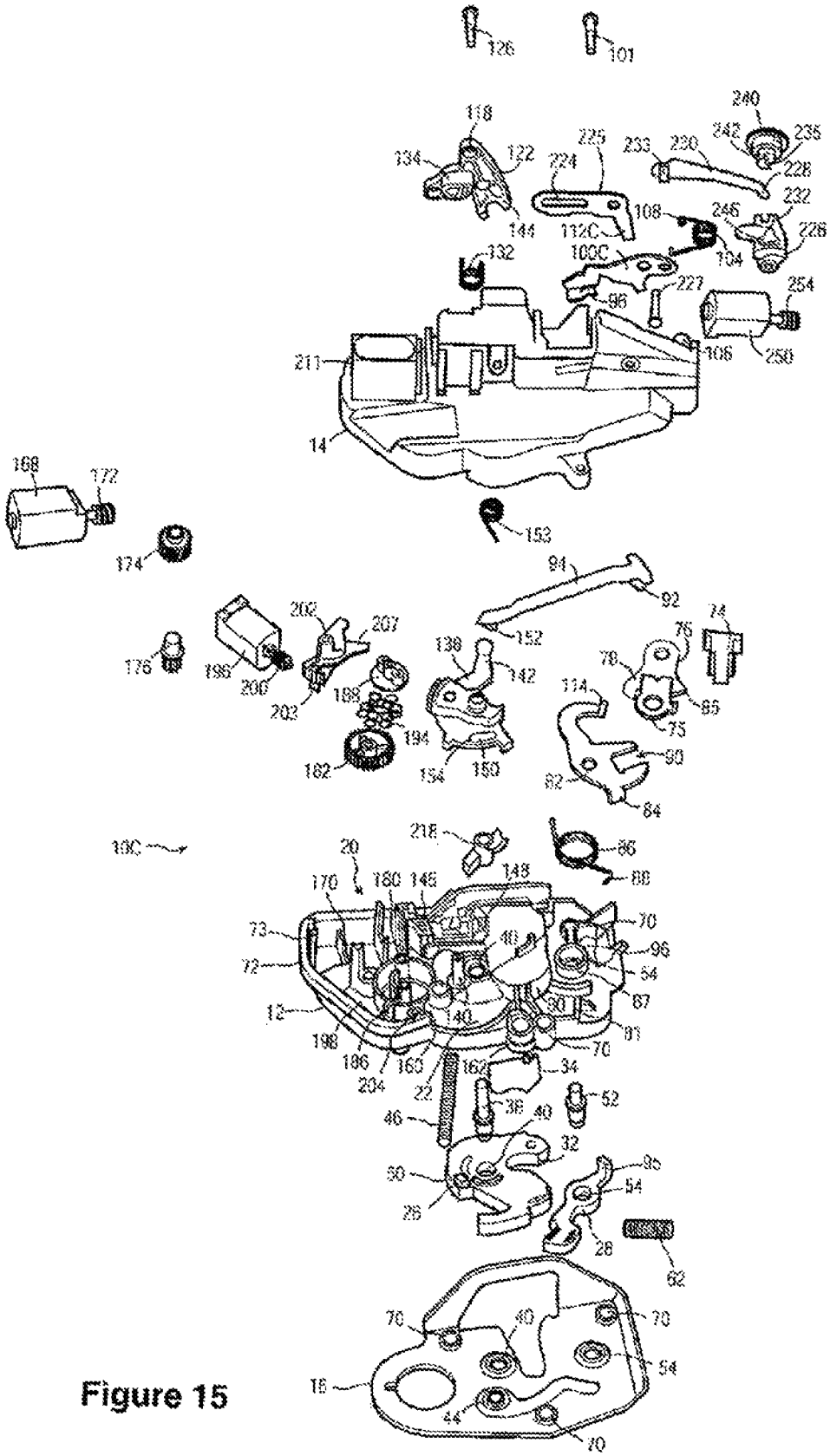
FIG. 15 is an exploded view of a cable-actuated, rear side door latch in accordance with another embodiment of the invention.
Figure 16:
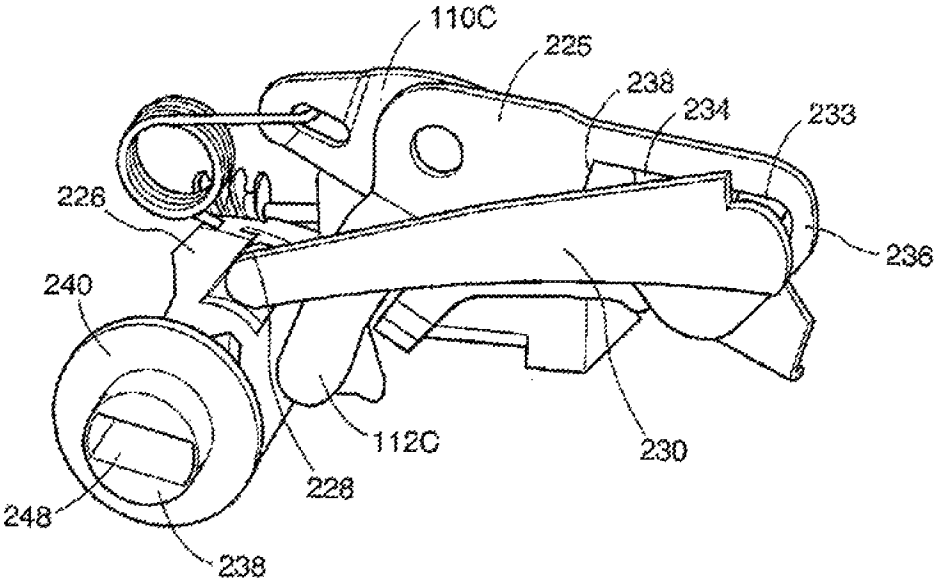
FIG. 16 shows an isometric view of a child lock assembly mounted to the latch shown in FIG. 15.

In addition to being mounted to a front driver-side and front passenger-side door, latch 10 can also be adapted for a rear side door. Latch 10C shares many of the components of latch 10. Referring now to FIGS. 15 and 16 a rear-door latch 10C is shown. Latch 10C is not normally equipped with an outside lock switch 220 or outside unlock switch 222. In addition, latch 10C does not include outside lock lever 158 (since rear doors typically lack key cylinders).

Inside release lever 100C lacks a depending tab 112 to actuate release lever 82. Instead, an auxiliary inside release lever 225 with a depending tab 112C is rotatably mounted to lever rivet 101 adjacent to inside release lever 100C. Thus, actuating auxiliary inside release lever 225 actuates release lever 82. As described above, actuating release lever 82 when link lock tab 92 is in the unlocked position actuates pawl insert 95 to release the latch.

Figure 17A:
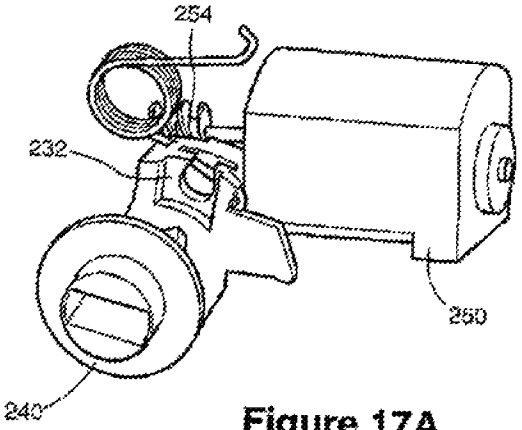
FIGS. 17A and 17B are cutaway views of the child lock assembly shown in FIG. 16.
Figure 17B:
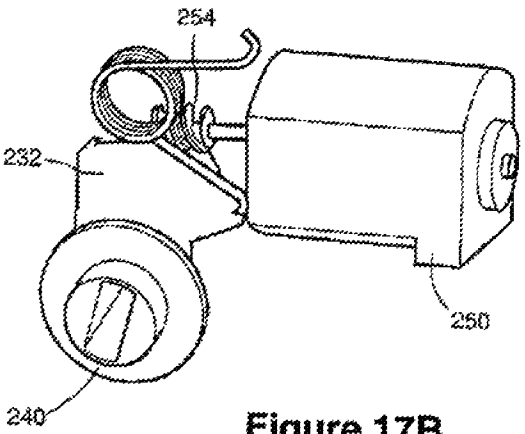

Preferably, latch 10C includes a child lock mechanism to disable the inside release assembly. Referring to FIGS. 16, 17A and 17B, a child lock lever 226 is pivotally mounted around a child lock pin 227 located in a hole 229 (FIG. 15) within latch cover 14. Child lock lever 226 is movable between a locked (FIG. 17A) and an unlocked position (FIG. 17B). A tab 228 depending from a first end of a child lock link lever 230 is retained within a claw 232 on child lock lever 226. A second tab 233 on child lock link lever 226 is slidably retained within a slot 234 on auxiliary inside release lever 225. As child lock lever 226 pivots between the locked and unlocked positions, child lock link lever 230 slides between a locked and an unlocked position within slot 234. When in the locked position, tab 233 on child lock link lever 230 abuts endwall 236 on auxiliary inside release lever 225. When in the unlocked position, tab 233 on child lock link lever 230 abuts against endwall 238.

When child lock link lever 230 is in the unlocked position, tab 233 abuts against inside release lever 100C. Thus, actuating inside release lever 100C actuates child lock link lever 230, which in turn actuates auxiliary inside release lever 225. As described above, actuating auxiliary inside release lever 204 actuates release lever 82 (FIG. 15) to release the latch (assuming link lock tab 92 is in the unlocked position). When child lock link lever 230 is in the locked position, tab 233 is displaced away from inside release lever 100C. Thus, actuating inside release lever 100C does not actuate child lock link lever 230, nor auxiliary inside release lever 225. Latch 10C is not released, regardless of whether link lock tab 92 is in the locked or the unlocked position. The rear inside release assembly is decoupled from ratchet 26 and pawl 28, preventing accidental door openings.

Figure 11:
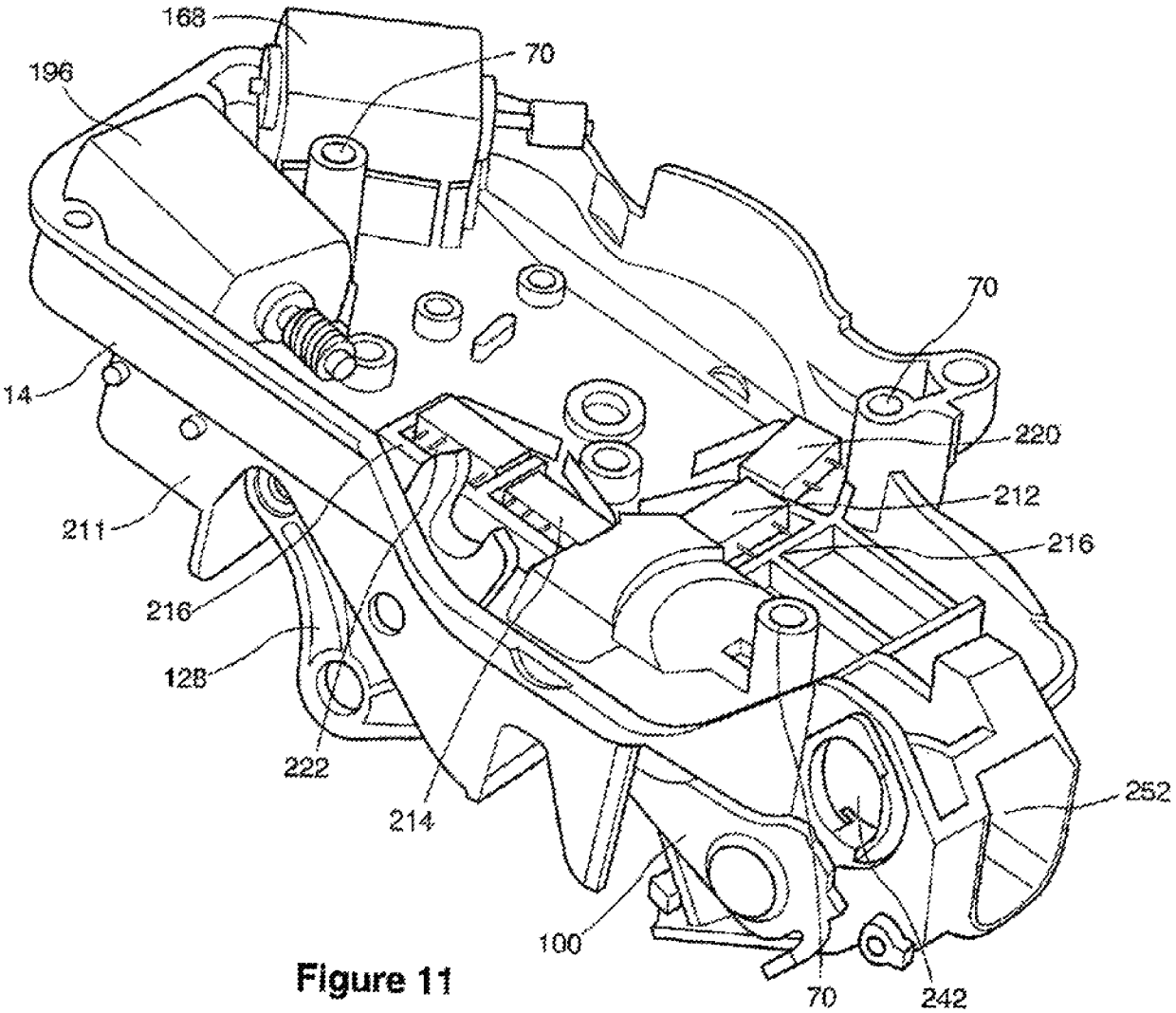
FIG. 11 is an isometric view of the latch cover mounted to the latch shown in FIGS. 1A and 1B.
Figure 12A:
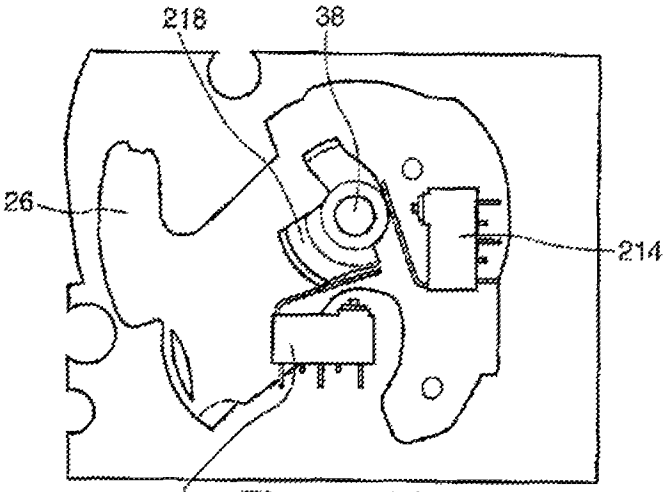
FIGS. 12A, 12B and 12C are plan views showing a door ajar and a door open switches in relation to a switch cam that are mounted to the latch shown in FIGS. 1A and 1B with the latch housing and latch cover removed.
Figure 12B:
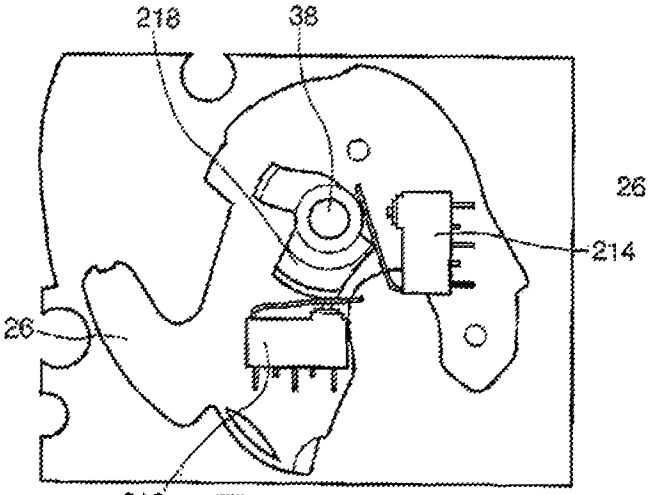
Figure 12C:
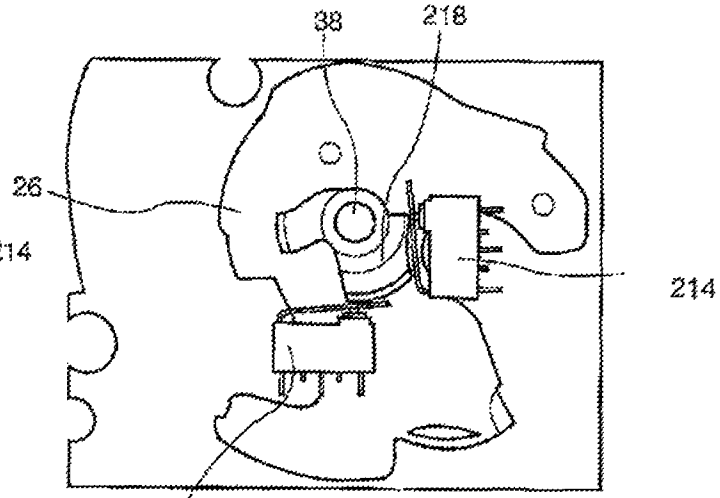

A child lock knob 240 is rotatably mounted to child lock lever 226, and extends through a hole 242 in latch cover 14 to the exterior surface of latch 10C (FIG. 11). A tab 244 (FIG. 14B) depending from child lock knob 240 fits within a slot 246 on child lock lever 226 so that rotating child lock knob 240 rotates child lock lever 226 between the locked and the unlocked position, providing a manual control for the child lock. An external groove 248 allows a person to manually rotate child lock knob 240 (typically with a slotted screwdriver).

In addition to the manual child lock feature, latch 10C can optionally provide a power child lock feature as well. Preferably, a child lock motor 250 is housed within a child lock motor housing 252, provided within latch cover 14 (FIG. 11). Child lock motor 250 is connected to the wiring harness (not shown). Child lock motor 252 is a DC motor that reversibly drives a worm 254. In turn, worm 254 meshes with gear teeth 256 extending out from child lock lever 226 (FIG. 15). Activating child lock motor 250 actuates child lock lever 226 to either the locked or the unlocked positions.

Rod Actuated Latch

Figure 18:
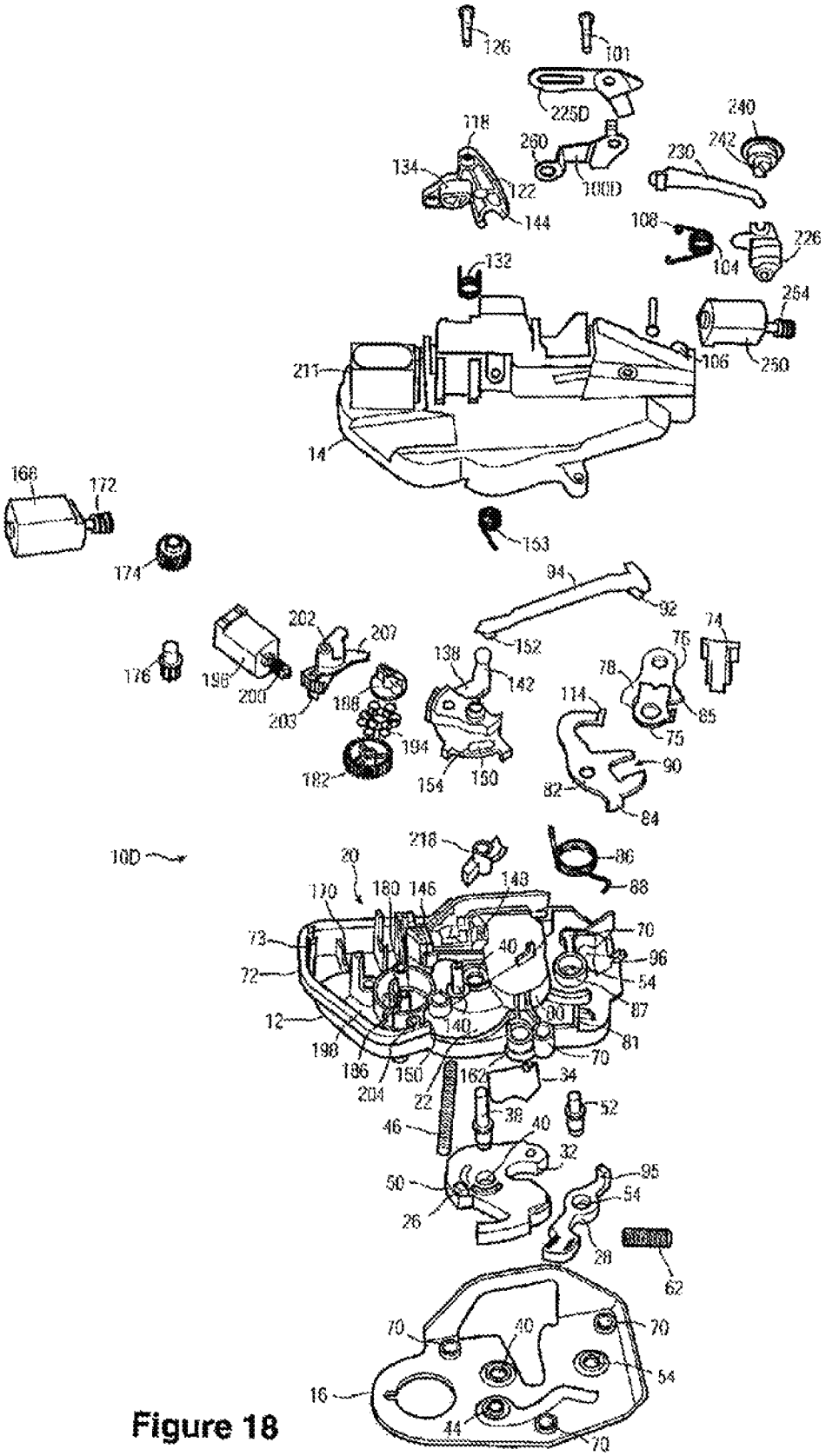
FIG. 18 is an exploded view of a rod-actuated, rear side door latch in accordance with another embodiment of the invention.

The above-described latches 10 are have cable-actuated inside release assemblies. However, it will be apparent to those of skill in the art that the inside release assemblies for both front and rear side door latches 10 can be modified to become rod-actuated. Referring now to FIG. 18, a rod-actuated, rear side door latch 10D is shown. Both the inside and outside release assemblies on latch 10D are rod actuated. A door rod (not shown) that is connected to the inside door handle (also not shown) is attached to a loop arm 258 on inside release lever 100D. Child link lock lever 230 selectively couples the rotation of inside release lever 100D with auxiliary inside release lever 225D.

Alternative Rear Door Latch with Child Lock

Referring now to FIG. 19A to 19D, a portion of a rear-door latch 10E is shown featuring an alternate embodiment of a child lock mechanism to disable the inside release assembly is shown. Inside release lever 100E pivots normally along rivet 101, thereby moving a depending arm 259 along an arc. An inside release lever spring 104E is provided to bias inside release lever 100E to the resting position. An auxiliary inside release lever 225E with a depending tab 112E is rotatably mounted to lever rivet 101 adjacent to inside release lever 100E. Auxiliary inside release lever 225E includes a slot 234E.

Figure 19A:
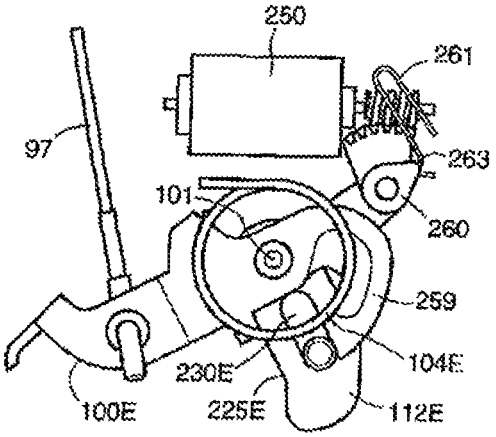
FIGS. 19A to 19D are plan views of a child lock assembly in isolation in accordance with another embodiment of the invention.
Figure 19B:
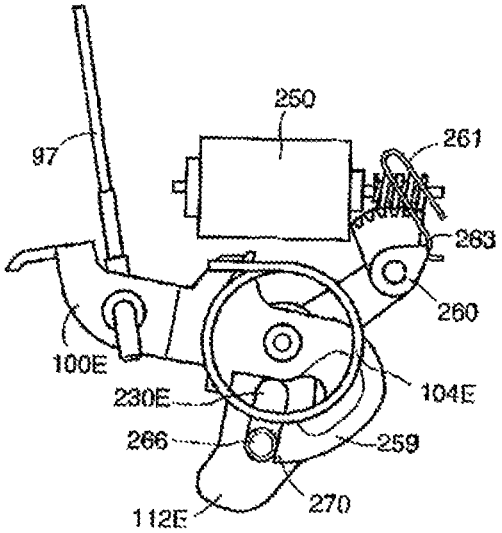
Figure 19C:
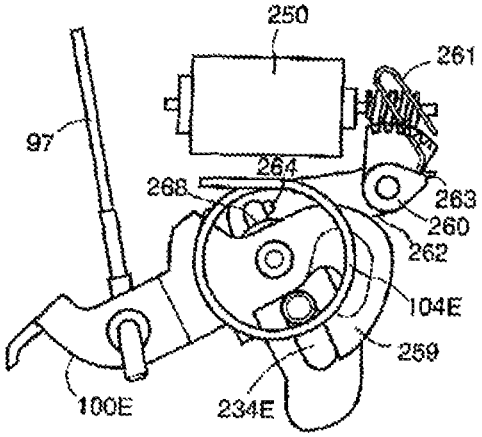
Figure 19D:
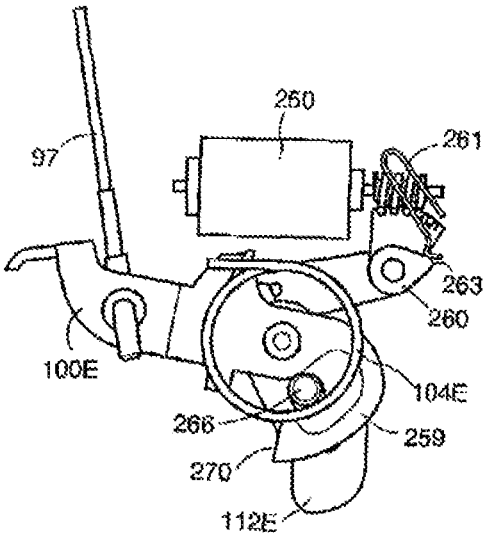

Child lock motor 250 meshes with a sector gear 260, and is operable to pivot sector gear 260 between a "child unlocked" position (FIGS. 19A and 19B) and a "child locked" (FIGS. 19C and 19D). A spring toggle 261 abuts against a gear shoulder 263 on sector gear 260 and is provided to bias sector gear 260 to its full child unlocked or child locked positions. A sector arm 262 extends out radially from sector gear 260 and includes a slot 264. A child lock link lever 230E spans between sector arm 262 and auxiliary inside release lever 225E. A first tab 266 depending from one end of child lock link lever 230E is located within slot 234E on inside release lever 225E, and a second tab 268 depending from the other end of child lock link lever 230E is located within slot 264 on sector arm 262. As sector gear 260 pivots between its child locked and child unlocked positions, child lock link lever 230E is translated so that first tab 266 slides between an unlocked (FIGS. 19A and 19B) and a locked position (FIGS. 19C and 19D) within slot 234E.

When child lock link lever 230E is in the unlocked position (FIGS. 19A and 19B), tab 266 abuts against an engagement surface 270 on the end of inside release lever 100E. Thus, pulling inside door cable 97 and actuating inside release lever 100E (FIG. 19B) pivots child lock link lever 230E, which in turn actuates auxiliary inside release lever 225E. As described earlier, actuating auxiliary inside release lever 225E causes depending tab 112E to actuate release lever 82 (FIG. 15) and release the latch (assuming link lock tab 92 is in the unlocked position).

When child lock link lever 230E is in the locked position (FIGS. 19C and 19D), tab 266 is displaced away from engagement surface 270. Thus, actuating inside release lever 100E (FIG. 19D) does not actuate child lock link lever 230E, nor auxiliary inside release lever 225E. Latch 10E is not released, regardless of whether link lock tab 92 is in the locked or the unlocked position. The rear inside release assembly is decoupled from ratchet 26 and pawl 28, preventing accidental door openings.

Power Release Function with Engage and Double Lock Override

Figure 20:
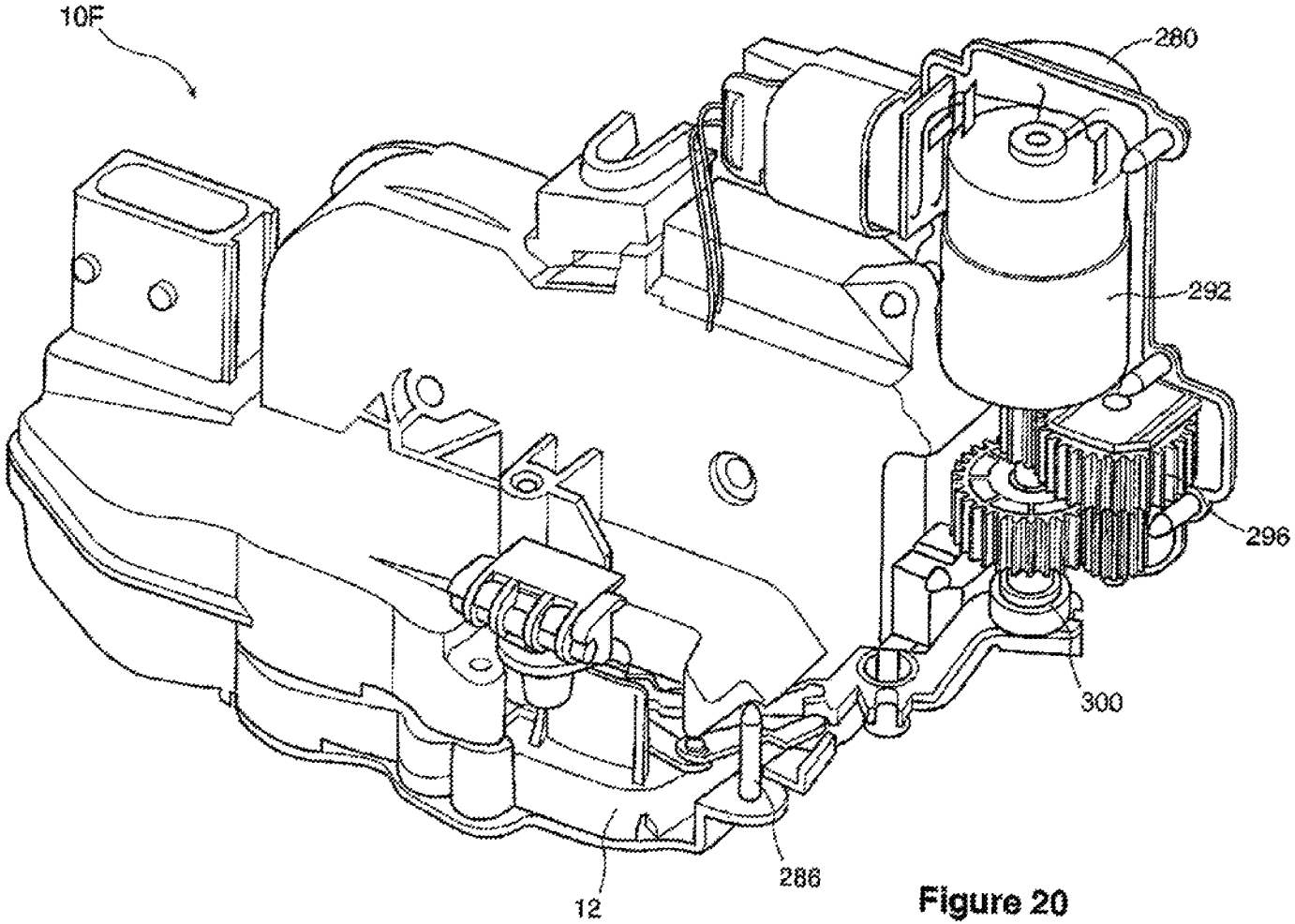
FIG. 20 is an isometric cutaway view of an alternate embodiment of a door latch with a power release actuator in accordance with another embodiment of the invention.
Figure 21:
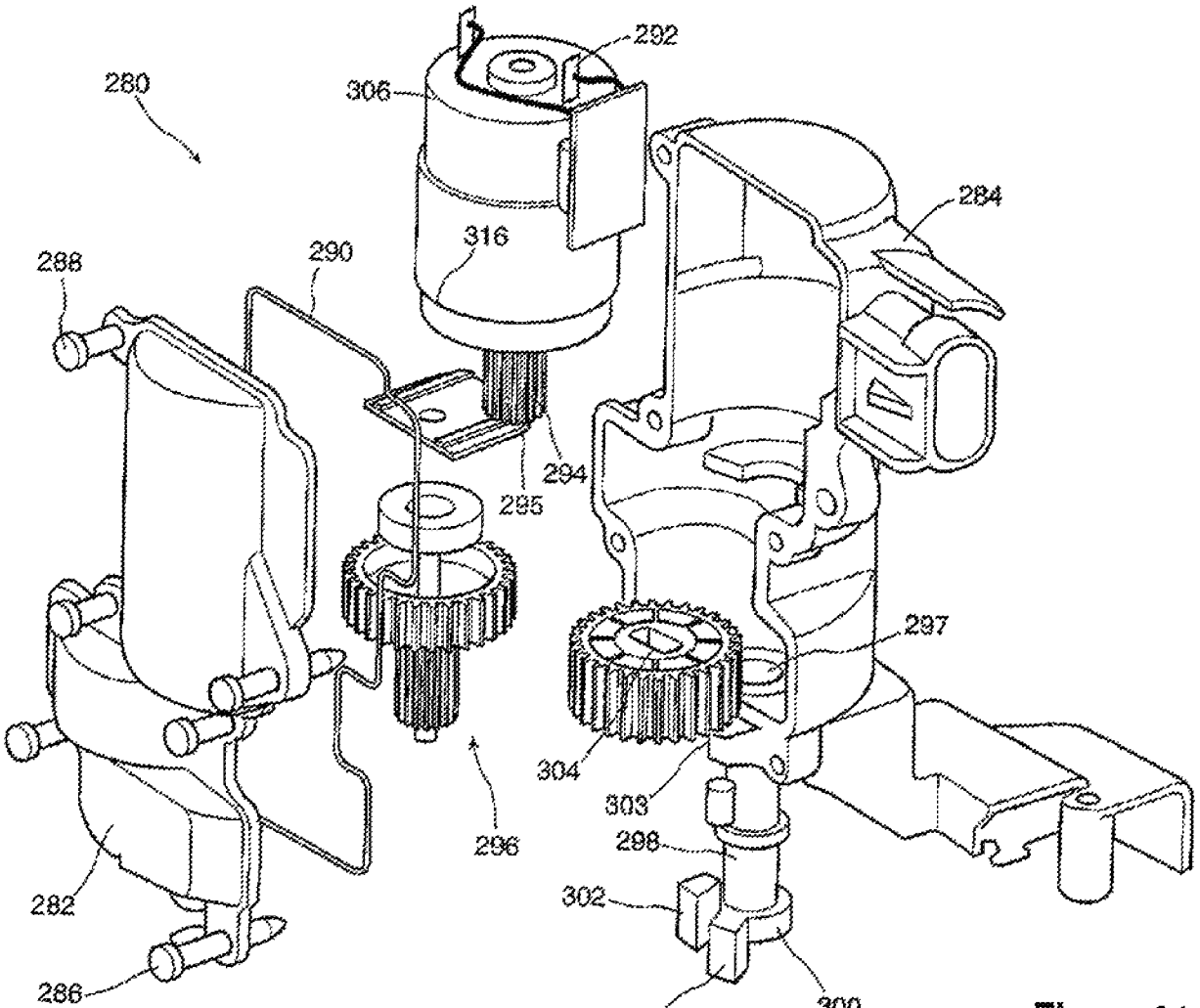
FIG. 21 is an exploded view of the power release actuator shown in FIG. 20.

Latch 10 can also be adapted to include a power release function. The power release function actuates pawl 28 directly, resulting in a faster latch release than when waiting for the latch to unlock. To use power release, the user carriers an RF transponder (not shown), typically a key fob. When the user steps within range of the vehicle, and actuates the vehicle door handle (not shown) the power release function is engaged. Referring now to FIGS. 20 and 21, a latch 10F is shown. Latch 10F includes an outboard power release actuator 280. Actuator 280 is adapted to be mounted onto latch housing 12, and includes a clam-shell actuator housing 282 and a complementary actuator cover 284. Fasteners 286 mount actuator 282 to latch housing 12 (FIG. 20), and additional fasteners 288 are used to fully secure actuator housing 282 and actuator cover 284 together. Both actuator housing 282 and actuator cover 284 are preferably formed from a rigid thermoplastic material. A rubberized seal 290 is provided between actuator housing 282 and actuator cover 284.

Actuator 280 includes a power release motor 292, which is activated when the outside door handle (not shown) is actuated and the remote transponder (not shown) is in range. Power release motor 292 is a unidirectional DC motor, and drives an output gear 294 via an output shaft 295. Output gear 294, in turn meshes with a two stage gear train 296. Those of skill in the art will recognize that the output gear 294 and gear train 296 are not particularly limited and other output gears (for example, a worm gear) and other gear train configurations could be used without departing from the scope of the invention. A Cam shaft 298 extends through and is freely pivotable within an aperture 297 in actuator housing 282. Cam shaft 298 is fixedly located into a axial mount 304 in gear train 296. A cam 300 is located on the end of cam shaft 298 outside of latch cover 284. The angular travel of cam 300 is delimited by a depending tab 302 abutting against a shoulder on stop 303 on latch cover 284, and is pivotable between a "resting" position against one side of stop 303 and an "actuated" position against the other. A return spring (not shown) is located within a spring housing 306 on power release motor 292 that is coaxial with output shaft 295. Activating the motor loads the return spring 306, and when the motor stops, the return spring reversibly drives the output shaft 295, returning cam 300 to its resting position.

Figure 22C:
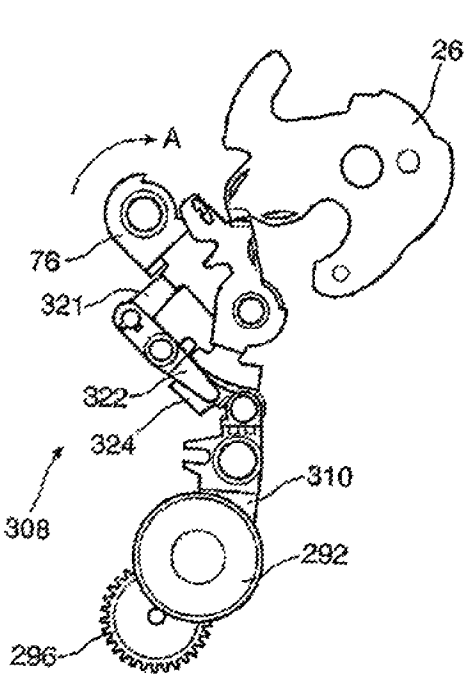
FIGS. 22A, 22B, and 22C are isolated views of a power release assembly for the door latch shown in FIG. 20.
Figure 22B:
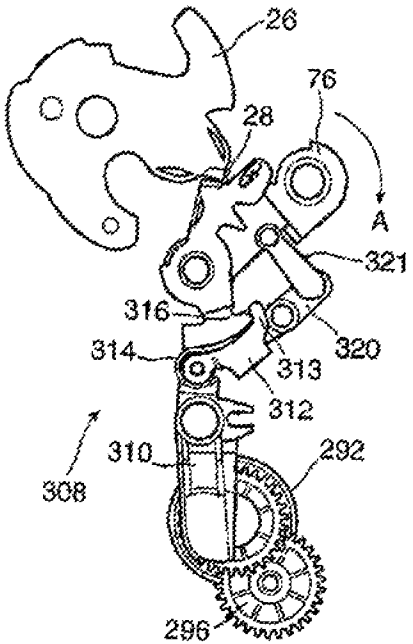
Figure 22A:
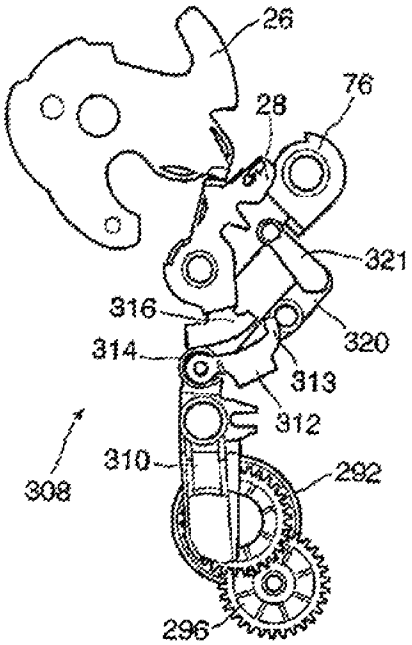

Referring now to FIGS. 22A to 22C, a set of linkages 308 is interconnected between cam 300 and outside release lever 76. Collectively, linkages 308 are operable to move between a "bypass" position (FIG. 22A), wherein activating actuator 280 does not actuate pawl 28 and an "engage" position (FIGS. 22B and 22C), wherein activating actuator 280 actuates pawl 28 to release the latch 10F. Linkages 308 include a power release lever 310 that is pivotally mounted on an eccentric boss 311 (FIG. 21) on cam 300, and extends generally towards pawl 28. Linkages 308 further include a pawl engage lever 312 that is pivotally mounted on power release lever 310 opposite boss 311. A pawl hook 313 is located on an end of pawl engage lever 312. An engagement spring 314 is mounted around power release lever 310 and pawl engage lever 312, and it urges pawl hook 313 on pawl engage lever 312 towards an engagement catch 316 on pawl 28. As is described in greater detail below, when linkages 308 are in the bypass position, pawl hook 313 remains displaced away from engagement catch 316, and when linkages 308 are in the engage position, pawl hook 313 abuts against engagement catch 316.

Linkages 308 further include an engage lever 320 that is pivotally mounted to a post 312 on latch housing 12. When linkages 308 are in the bypass position, an arm 322 on engage lever 320 abuts against a sidewall 324 on pawl engage lever 312 forcing pawl hook 313 away from engagement catch 316. When linkages 308 are in the engage position, arm 322 on engage lever 320 is rotated away from sidewall 324, so that engagement spring 314 pivots pawl engage lever 312 adjacent to pawl 28.

Linkages 308 further include an engage link lever 321 that is pivotally connected at one end engage lever 320 and, at the other end to outside release lever 76. The rotational movement of engage lever 320 is therefore coupled to the movement of outside release lever 76. When outside release lever 76 is in its resting position, linkages 308 are pivoted to the bypass position. When outside release lever 76 is pivoted towards its actuated position (indicated by the arrow labeled 'A'), linkages 308 are pivoted to the engage position. Arm 322 on engage lever 320 rotates away from sidewall 324, and engagement spring 314 pivots the pawl hook 313 to abut against engagement catch 316. In the presently illustrated embodiment, outside release lever 76 does not need to fully reach its actuated position for linkages 308 to move into the engage position. When outside release lever 76 returns to its resting position, linkages 308 pivot back to the bypass position.

When actuator 280 activates, power release motor 292 pivots cam 300 from its resting to its actuate position. If linkages 308 are in the bypass position, the movement of pawl hook 313 is displaced away from engagement catch 316 so that pawl 28 is not actuated. Thus, if actuator 280 is accidentally activated, the latch is not released. If linkages 308 are in the engage position (i.e., a user pulls on the outside handle to actuate outside release lever 76 while carrying a valid transponder), pawl hook 313 catches engagement catch 316, and pawl 28 is actuated to release the latch.

Figure 23:
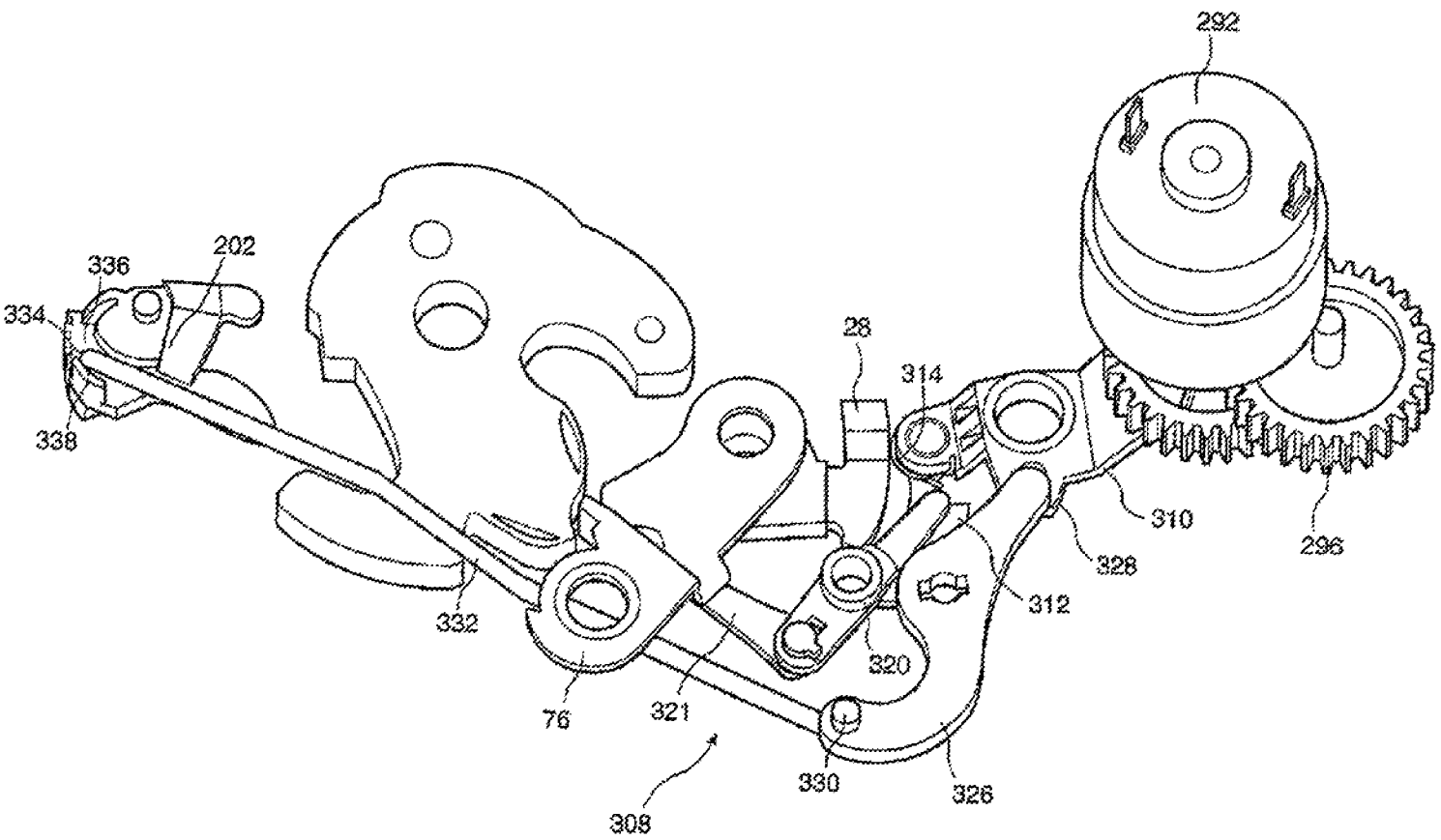
FIG. 23 is an isolated view of a double lock override assembly for the door latch shown in FIG. 20.

When actuator 280 actuates pawl 28 to release latch 10F, it also disengages the double lock on the latch so that the latch is double-unlocked. Double-unlocking is not required to release the latch, but it enables the inside and outside door handles (not shown) for future releases. Referring now to FIG. 23, an override lever 326 is pivotally mounted within a claw 328 on power release lever 310. A first end 330 of an override rod 332 is pivotally mounted to override lever 326 on the end opposite claw 328. Override rod 332 extends through an opening in latch 10F (not shown) so that a second end 334 of override rod 312 is located within a slot 336 on deadbolt sector gear 202. When deadbolt sector gear 202 is in its double locked position, second end 334 abuts against a sidewall 338 at one end of slot 336. When cam 300 rotates to activate the power release, the second end 334 of override rod 332 pushes against sidewall 338 to pivot deadbolt sector gear 202 to its un-double locked position, thereby unlocking latch 10F. The override rod 332 does not replace double lock motor 196, but instead provides a redundant failsafe. When double lock motor 196 later pivots deadbolt sector gear 202 to its double locked position, second end 334 moves freely within slot 336.

Improved Housing

Figure 24A:
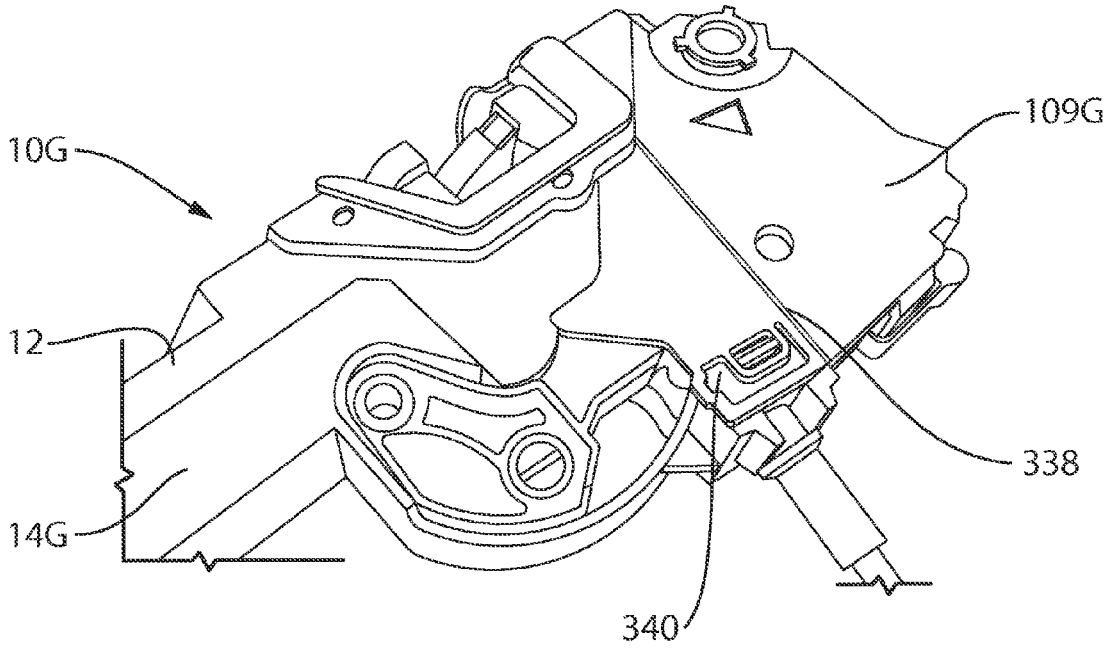
FIGS. 24A and 24B are isometric views of an alternate embodiment of a door latch having a living hinge shown in both the closed and open positions respectively.
Figure 24B:
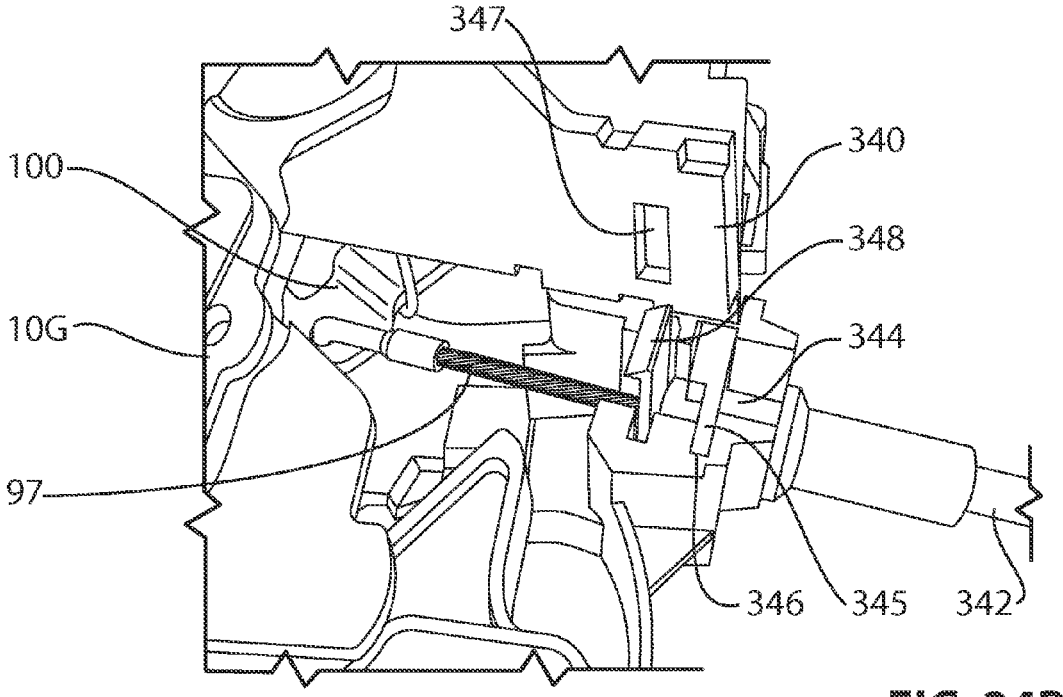

Referring now to FIGS. 24A and 24B, an improved latch 10G is shown that uses a living hinge to provide access to inside release lever 100 and inside door cable 97. A side cover 109G attached to latch cover 14G includes a living hinge 338 that allows a flap 340 to pivot between a closed position (shown in 24A), and an open position (shown in 24B). A elastomeric sheath 342 is provided for inside release cable 97 which terminates in a bushing 344. Bushing 344 includes a plurality of flanges 345 that are nested into niches 346 in latch cover 14G, thereby retaining inside door cable 97 in place. Flap 340 includes a slot 347 that is aligned with an integral tab 348 extending from one of the flanges 345. Thus, when flap 340 is in the closed position, tab 348 extends through slot 347, retaining the flap in the closed position via a snap fit. Flap 340 can be manually opened or closed (to allow an assembler to connect inside release cable 97 to inside release lever 100), but will not open accidentally during normal use of the latch.

Latch 10G can thus be assembled and shipped without an inside door cable 97, and inside cable 97 can be attached without removing side cover 109G. Instead, flap 340 can be pivoted to the open position, exposing inside release lever 100. The end of inside door cable 97 (typically a hook or ball end) is connected to inside release lever 100. Once inside door cable 97 is attached to inside release lever 100, an assembler can simply apply pressure to bushing 344 so that flanges 345 slide into niches 346, ensuring a solid fit. Once inside cable 97 is lodged into place, flap 340 is moved to the closed position and tab 348 passes through slot 347 to lock flap 340 in the closed position. Those of skill in the art will appreciate that while only a single flap 340 is illustrated, latch 10G could be equipped with multiple living hinges, thereby providing access to the interior of the latch.

Improved Motor Housing

Figure 25:
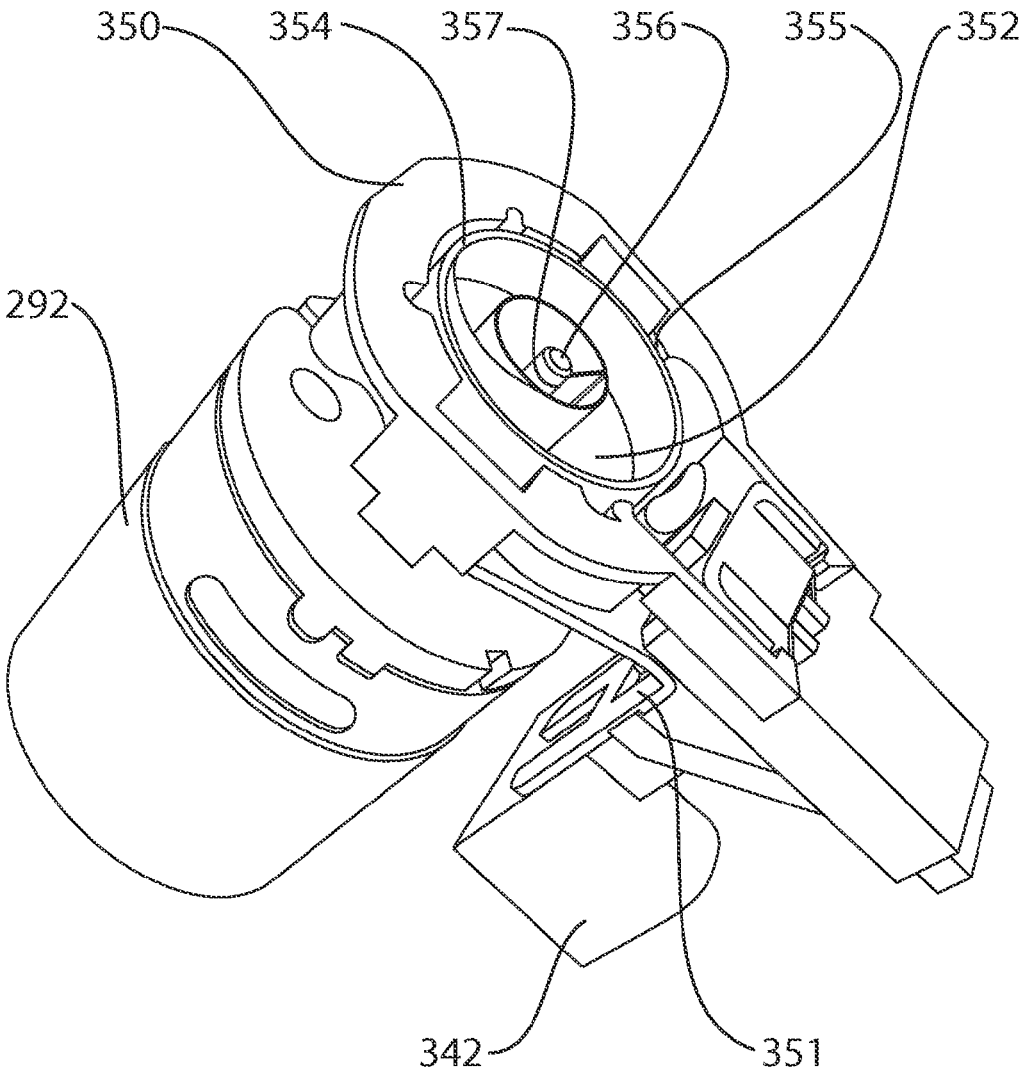
FIG. 25 is an isometric view of a motor housing adapted for the latches shown in FIGS. 1-24.

Referring now to FIG. 25, an improved housing for a motor is shown at 350. Motor housing 350 is operable to locate and retain power release motor 292. Motor housing 350 is formed from molded plastic and contains all the electrical traces 351 for the motor. A recessed chamber 352 is formed on a side of motor housing 350 opposite the motor. A clock spring 354 is located within chamber 352 and abuts against chamber sidewall 355. A motor axle 356 extends through an aperture in motor housing 350 and is connected to an end of clock spring 354 via an arbor 357. Engaging the motor winds clock spring 354 so that when the motor disengages, clock spring 354 unwinds and returns the motor to its starting position.

Improved Pawl

Figure 26:
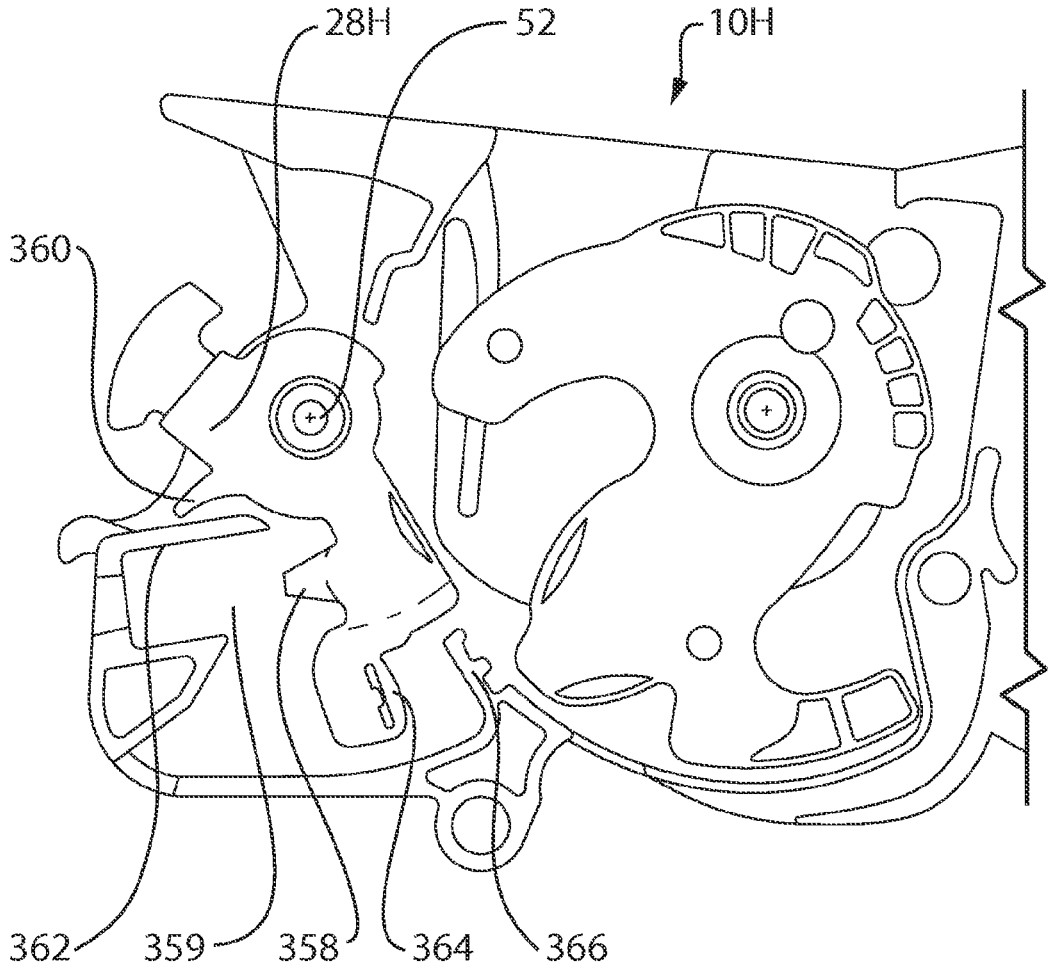
FIG. 26 is a top profile view of an alternate embodiment of a door latch having a modified pawl.

Referring now to FIG. 26, a latch 10H is shown having an improved pawl 28H. Pawl 28H includes a spring locator 358 that is sized as to coaxially mount a helical spring (not shown) that is retained within spring chamber 359, and thus biases paw 28H to the engaged position. Pawl 28H further includes a flexible finger 360 which extends out from the pawl proximate pawl rivet 52. As pawl 28H moves along a travel path from the released position to its engaged position, finger 360 is dragged against an inwardly extending sidewall portion 362 on housing 22, slowing the motion of the pawl and reducing unwanted noise. A pillow bumper 364 is provided to dampen the sounds of pawl 28H when it moves from the released position. As pawl 28H returns to rest position due to spring pressure, bumper 364 impacts against another sidewall portion 366, dampening unwanted noise.

While the embodiments discussed herein are directed specific embodiments of the invention, it will be understood that combinations, sub-stets and variations of the embodiments of the invention are within the scope of the invention.

| Parts List |
|---|
| latch 10 |
| latch 10B |
| latch 10C |
| latch 10D |
| latch 10E |
| latch 10F |
| latch 10G |
| latch 10H |
| latch housing 12 |
| latch cover 14 |
| latch cover 14G |
| frame plate 16 |
| outer chamber 18 |
| inner chamber 20 |
| substrate 22 |
| peripheral walls 24 |
| ratchet 26 |
| pawl 28 |
| pawl 28H |
| fishmouth 30 |
| hook arm 32 |
| overslam bumper 34 |
| outer seal 36 |
| ratchet rivet 38 |
| holes 40 |
| open position stop bumper 42 |
| overslam post 44 |
| ratchet spring 46 |
| spring channel 47 |
| sidewall 48 |
| tab 50 |
| pawl rivet 52 |
| holes 54 |
| ratchet shoulder 56 |
| primary tooth 58 |
| secondary tooth 60 |
| pawl spring 62 |
| sidewall 64 |
| spring shoulder 66 |
| sound dampeners 68 |
| fastener holes 70 |
| peripheral sidewalls 72 |
| inner lip 73 |
| adjustable rod clip 74 |
| clip arm 75 |
| outside release lever 76 |

-continued

| Parts List |
|---|
| depending tab 78 |
| sidewall 80 |
| sidewall 81 |
| release lever 82 |
| depending tab 84 |
| release lever spring 86 |
| hollow post 87 |
| hook 88 |
| lock link slot 90 |
| lock link tab 92 |
| lock link lever 94 |
| pawl insert 95 |
| slot 96 |
| inside door cable 97 |
| ball end 98 |
| hook arm 99 |
| inside release lever 100 |
| inside release lever 100C |
| inside release lever 100D |
| inside release lever 100E |
| lever rivet 101 |
| tab 102 |
| inside release lever spring 104 |
| inside release lever spring 104E |
| post 106 |
| arms 108 |
| sidewall portion 109 |
| side cover 109G |
| tab 110 |
| depending tab 112 |
| depending tab 112C |
| depending tab 112E |
| inside release arm 114 |
| loop 118 |
| inside lock lever 122 |
| lever rivet 126 |
| rivet holes 130 |
| lock toggle spring 132 |
| spring arm 133 |
| lever post hole 134 |
| cover post hole 136 |
| lock lever 138 |
| post 140 |
| arm 142 |
| claw 144 |
| shoulder 146 |
| shoulder 148 |
| lock lever bumper 149 |
| slot 150 |
| link lock tab 152 |
| lock link spring 153 |
| sidewall 154 |
| loop 156 |
| outside lock lever 158 |
| shoulder stop 160 |
| shoulder stop 162 |
| outside shoulder 164 |
| outside shoulder 166 |
| lock motor 168 |
| lock chamber 170 |
| worm 172 |
| worm gear 174 |
| pinion 176 |
| pin 178 |
| hole 180 |
| gear spur 182 |
| pin 184 |
| hole 186 |
| cam 188 |
| cam arm 190 |
| cam shoulder 191 |
| cam arm 192 |
| cam shoulder 193 |
| radial bumper 194 |
| frictional spring 195 |
| double lock motor 196 |
| post 197 |

-continued

| Parts List |
|---|
| double lock chamber 198 |
| worm 200 |
| deadbolt sector gear 202 |
| post 203 |
| hole 204 |
| deadbolt sidewall 205 |
| deadbolt sidewall 206 |
| deadbolt arm 207 |
| side face 208 |
| shoulder 209 |
| release arm 210 |
| connector passage 211 |
| door ajar switch 212 |
| door open switch 214 |
| switch niches 216 |
| switch cam 218 |
| switch cam 218B |
| outside lock switch 220 |
| outside unlock switch 222 |
| lockout tab 223 |
| lockout shoulder 224 |
| auxiliary inside release lever 225 |
| auxiliary inside release lever 225D |
| auxiliary inside release lever 225E |
| child lock lever 226 |
| child lock pin 227 |
| tab 228 |
| hole 229 |
| child lock link lever 230 |
| child lock link lever 230E |
| claw 232 |
| second tab 233 |
| slot 234 |
| slot 234E |
| endwall 236 |
| endwall 238 |
| child lock knob 240 |
| hole 242 |
| tab 244 |
| slot 246 |
| external groove 248 |
| child lock motor 250 |
| child lock motor housing 252 |
| worm 254 |
| adjustable rod clip 256 |
| loop arm 258 |
| arm 259 |
| sector gear 260 |
| spring toggle 261 |
| sector arm 262 |
| gear shoulder 263 |
| slot 264 |
| tab 266 |
| tab 268 |
| engagement surface 270 |
| actuator 280 |
| actuator housing 282 |
| actuator cover 284 |
| fasteners 286 |
| fasteners 288 |
| seal 290 |
| power release motor 292 |
| output gear 294 |
| output shaft 295 |
| gear train 296 |
| cam shaft 298 |
| aperture 297 |
| cam 300 |
| depending tab 302 |
| stop 303 |
| axial mount 304 |
| spring housing 306 |
| linkages 308 |
| power release lever 310 |
| boss 311 |
| pawl engage lever 312 |
| pawl hook 313 |

-continued

| Parts List |
|---|
| engagement spring 314 |
| engagement catch 316 |
| housing post 316 |
| engage lever 320 |
| first arm 321 |
| second arm 322 |
| sidewall 324 |
| override lever 326 |
| calw 328 |
| first end 330 |
| override rod 332 |
| second end 334 |
| slot 336 |
| sidewall 338 |
| living hinge 339 |
| flap 340 |
| elasometric sheath 342 |
| bushing 344 |
| flanges 345 |
| niches 346 |
| slot 347 |
| integral tab 348 |
| motor housing 350 |
| electrical traces 351 |
| recessed chamber 352 |
| clock spring 354 |
| chamber sidewall 355 |
| motor axle 356 |
| arbor 357 |
| spring located 358 |
| spring chamber 359 |
| flexible finger 360 |
| sidewall portion 362 |
| pillow bumper 364 |
| sidewall portion 366 |

What is claimed is:

1. A latch for an automotive door, comprising:

a housing having an inwardly extending sidewall portion;

a ratchet and pawl mounted to the housing, the ratchet operable to move between a ratchet engaged position to hold a striker and a ratchet released position to permit release of the striker, wherein the pawl is operable to move along a travel path between a pawl engaged position wherein the pawl prevents movement of the ratchet to the ratchet released position, and a pawl released position wherein the pawl permits the ratchet to rotate towards the ratchet released position;

a spring biasing the pawl to the engaged position; and a resilient finger extending out from the pawl and located so as to drag against the inwardly extending sidewall portion of the housing over a majority of the travel path of the pawl between the released position and the engaged position, thereby slowing the pawl.

2. The latch of claim 1, wherein the pawl further includes a bumper that is located so as to impact against a portion of the housing when the pawl reaches the engaged position.

3. A latch for an automotive door, comprising:

a housing;

a ratchet and pawl mounted to the housing, the ratchet operable to move between a ratchet engaged position to hold a striker and a ratchet released position to permit release of the striker, wherein the pawl is operable to move along a travel path between a pawl engaged position wherein the pawl prevents movement of the ratchet to the ratchet released position, and a pawl released position wherein the pawl permits the ratchet to rotate towards the ratchet released position;

a spring, biasing the pawl to the engaged position; and a resilient finger extending out from the pawl, wherein the resilient finger drags along a portion of the housing over a majority of the travel path of the pawl between the released position and the engaged position.

4. The latch of claim 3, wherein the pawl further includes a bumper that is located so as to impact against a portion of the housing when the pawl reaches the engaged position.

5. The latch of claim 1, wherein the pawl includes a spring locator sized to coaxially mount a spring and bias the pawl to the pawl engaged position.

6. The latch of claim 5, wherein the spring locator is located on the same side of the pawl as the resilient finger and extends out from the pawl in the same direction as the resilient finger.

7. The latch of claim 2, wherein the housing includes peripheral sidewalls, the inwardly extending sidewall portion of the housing is located to frictionally engage the resilient finger and extends transverse to one of the peripheral sidewalls, and the portion of the housing located to impact the bumper extends transverse to another one of the peripheral sidewalls.

8. The latch of claim 2, wherein the portion of the housing located to impact the bumper is disposed between the pawl and the ratchet.

9. The latch of claim 3, wherein the pawl includes a spring locator sized to coaxially mount a spring and bias the pawl to the pawl engaged position.

10. The latch of claim 9, wherein the spring locator is located on the same side of the pawl as the resilient finger and extends out from the pawl in the same direction as the resilient finger.

11. The latch of claim 3, wherein the resilient finger is positioned to drag along an inwardly extending sidewall portion of the housing.

12. The latch of claim 11, wherein the housing includes peripheral sidewalls, the inwardly extending sidewall portion of the housing extends transverse to one of the peripheral sidewalls, and the portion of the housing located to impact the bumper extends transverse to another one of the peripheral sidewalls.

13. The latch of claim 4, wherein the portion of the housing located to impact the bumper is disposed between the pawl and the ratchet.

14. The latch of claim 1, wherein the resilient finger drags against the inwardly extending sidewall portion of the housing over the travel path of the pawl from the released position to the engaged position.

15. The latch of claim 3, wherein the resilient finger drags along the housing over the travel path of the pawl from the released position to the engaged position.

* * * * *